US011241880B2

(12) United States Patent
Kondo

(10) Patent No.: US 11,241,880 B2
(45) Date of Patent: Feb. 8, 2022

(54) DRIVE CIRCUIT AND LIQUID EJECTING APPARATUS

(71) Applicant: Seiko Epson Corporation, Tokyo (JP)

(72) Inventor: Yoichiro Kondo, Chino (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 16/879,865

(22) Filed: May 21, 2020

(65) Prior Publication Data

US 2020/0369027 A1 Nov. 26, 2020

(30) Foreign Application Priority Data

May 22, 2019 (JP) ..... JP2019-095897

(51) Int. Cl.
*B41J 2/045* (2006.01)

(52) U.S. Cl.
CPC ..... *B41J 2/0457* (2013.01); *B41J 2/0459* (2013.01); *B41J 2/04541* (2013.01); *B41J 2/04548* (2013.01); *B41J 2/04581* (2013.01)

(58) Field of Classification Search
CPC ..... B41J 2/04581
See application file for complete search history.

(56) References Cited

U.S. PATENT DOCUMENTS

2014/0098385 A1 4/2014 Endo et al.
2015/0246530 A1* 9/2015 Abe ..... B41J 2/04593 347/10
2016/0221331 A1* 8/2016 Sano ..... B41J 2/0459
2019/0291422 A1* 9/2019 Takagi ..... B41J 2/04596

FOREIGN PATENT DOCUMENTS

JP 2014-076562 A 5/2014
JP 2016-141070 A 8/2016

* cited by examiner

*Primary Examiner* — Shelby L Fidler
(74) *Attorney, Agent, or Firm* — Harness, Dickey & Pierce, P.L.C.

(57) ABSTRACT

A drive circuit that drives a piezoelectric device including a drive signal selection control circuit which controls supply of the drive signal to the piezoelectric element, the drive circuit including a drive signal output circuit that outputs the drive signal, a power supply voltage signal output circuit that outputs a power supply voltage signal, and a power supply voltage control circuit that controls supply of the power supply voltage signal to the drive signal selection control circuit, in which the drive signal output circuit includes a modulation circuit, an amplification circuit, a demodulation circuit, a feedback circuit, and a discharge circuit, a first wiring electrically couples the drive signal selection control circuit and the power supply voltage control circuit to each other, and the discharge circuit is electrically coupled to a second wiring through which the drive signal output from the demodulation circuit propagates, through the feedback circuit.

3 Claims, 16 Drawing Sheets

| | | LARGE DOT | MEDIUM DOT | SMALL DOT | SLIGHT VIBRATION |
|---|---|---|---|---|---|
| [SIH, SIL] | | [1, 1] | [1, 0] | [0, 1] | [0, 0] |
| S | T1 | H | H | L | L |
| | T2 | H | L | H | L |
| | T3 | L | L | L | H |

DRIVE CIRCUIT AND LIQUID EJECTING APPARATUS

The present application is based on, and claims priority from JP Application Serial Number 2019-095897, filed May 22, 2019, the disclosure of which is hereby incorporated by reference herein in its entirety.

BACKGROUND

1. Technical Field

The present disclosure relates to a drive circuit and a liquid ejecting apparatus.

2. Related Art

As a liquid ejecting apparatus such as an ink jet printer that ejects a liquid such as ink to print an image or a document, an apparatus using a piezoelectric element such as a piezo element is known. The piezoelectric elements are provided corresponding to a plurality of nozzles for ejecting ink and a cavity for storing the ink ejected from the nozzles in a print head. When the piezoelectric element is displaced in accordance with a drive signal, a diaphragm provided between the piezoelectric element and the cavity is bent, and a volume of the cavity is changed. As a result, a predetermined amount of ink is ejected from the nozzle at a predetermined timing, and a dot is formed on a medium.

JP-A-2016-141070 discloses a liquid ejecting apparatus that ejects a predetermined amount of liquid from a nozzle by supplying a high voltage Vh of DC 42 V to a drive circuit which outputs a drive signal and a selection portion which controls supply of the drive signal to a piezoelectric element, and generating the drive signal to be supplied to the piezoelectric element based on the supplied voltage Vh by the drive circuit and the selection portion.

However, in the liquid ejecting apparatus described in JP-A-2016-141070 in which the high voltage Vh is supplied to the drive circuit and the selection portion, in a sleep mode or the like in which the liquid ejecting apparatus does not eject liquid, a minute leak current due to the voltage Vh flows through the selection portion, and charges are accumulated in the piezoelectric element due to the influence of the leak current. As a result, there is a possibility that unintended displacement may occur in the piezoelectric element.

SUMMARY

According to an aspect of the present disclosure, there is provided a drive circuit that drives a piezoelectric device including a piezoelectric element to which a drive signal is supplied, and a drive signal selection control circuit which controls supply of the drive signal to the piezoelectric element, the drive circuit including a drive signal output circuit that outputs the drive signal, a power supply voltage signal output circuit that outputs a power supply voltage signal, and a power supply voltage control circuit that controls supply of the power supply voltage signal to the drive signal selection control circuit, in which the drive signal output circuit includes a modulation circuit that modulates an original drive signal and outputs a modulation signal, an amplification circuit that amplifies the modulation signal and outputs an amplified modulation signal, a demodulation circuit that demodulates the amplified modulation signal and outputs the drive signal, a feedback circuit that feeds back the drive signal to the modulation circuit, and a discharge circuit electrically coupled to the feedback circuit, the feedback circuit is electrically coupled to a first wiring through which the power supply voltage signal propagates, the first wiring electrically couples the drive signal selection control circuit and the power supply voltage control circuit to each other, and the discharge circuit is electrically coupled to a second wiring through which the drive signal output from the demodulation circuit propagates, through the feedback circuit.

In the drive circuit, the circuit may further include a detection circuit that detects a voltage value of the first wiring through which the power supply voltage signal propagates.

In the drive circuit, the discharge circuit may discharge a charge of the second wiring when the detection circuit detects a decrease in the voltage value.

In the drive circuit, a wiring that electrically couples the power supply voltage signal output circuit and the power supply voltage control circuit to each other, and the amplification circuit may be electrically coupled to each other.

According to another aspect of the present disclosure, there is provided a liquid ejecting apparatus including the drive circuit according to any one of aspects 1 to 4, and a print head that includes the piezoelectric device.

DESCRIPTION OF EXEMPLARY EMBODIMENTS

Hereinafter, preferred embodiment of the present disclosure will be described with reference to the drawings. The drawings used are for convenience of description. The embodiment described below does not unduly limit the contents of the present disclosure described in the aspects. In addition, not all of the configurations described below are essential constituent requirements of the present disclosure.

1. First Embodiment

1. 1 Configuration of Liquid Ejecting Apparatus

A printing apparatus as an example of a liquid ejecting apparatus according to the present embodiment is an ink jet printer that forms dots on a print medium such as a paper by ejecting an ink in accordance with image data input from an external host computer, and prints an image including characters, graphics, and the like according to the image data.

Figure 1:
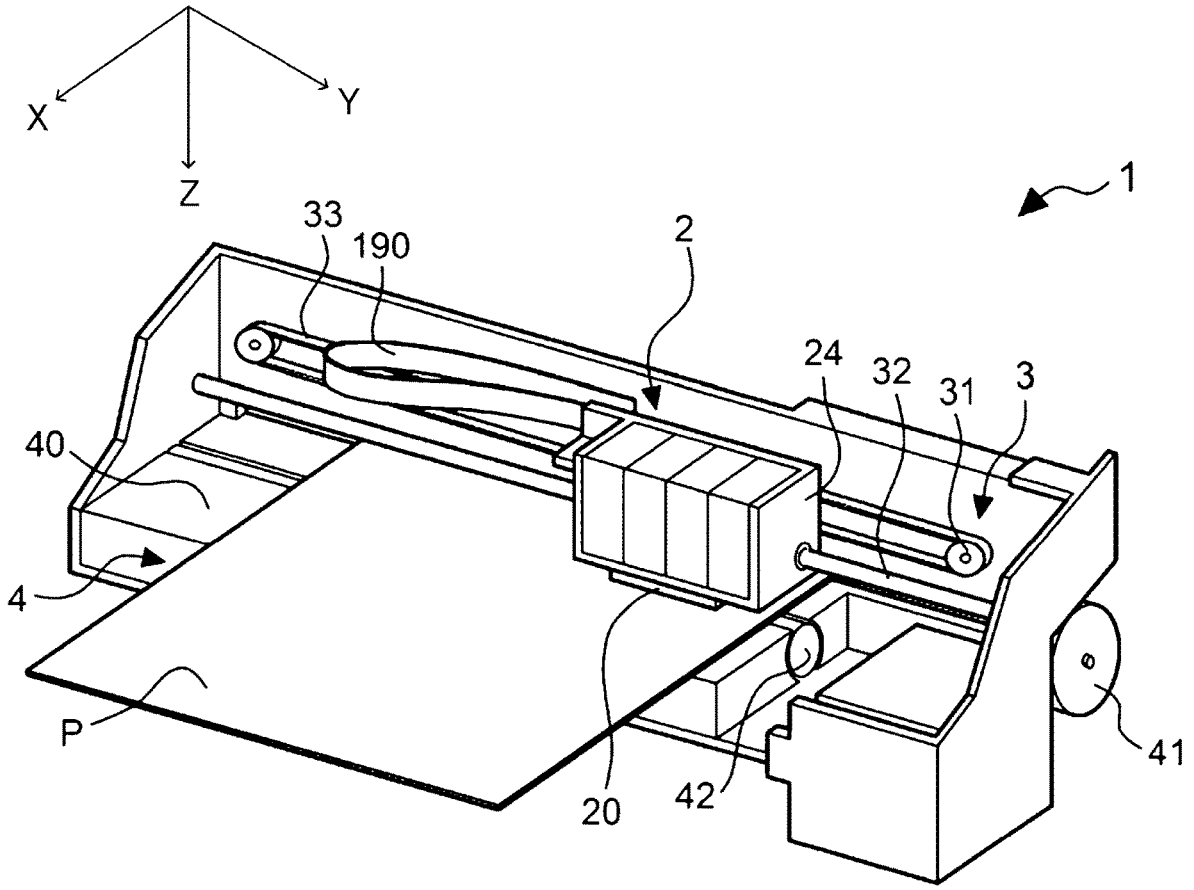
FIG. 1 is a perspective view illustrating a schematic configuration of a liquid ejecting apparatus.

FIG. 1 is a perspective view illustrating a schematic configuration of a liquid ejecting apparatus 1. FIG. 1 illustrates a direction X in which a medium P is transported, a direction Y in which a moving object 2 reciprocates across the direction X, and a direction Z in which an ink is ejected. In the present embodiment, the direction X, the direction Y, and the direction Z are described as axes orthogonal to each other, and the present disclosure is not limited to the various components of the liquid ejecting apparatus 1 being disposed orthogonal to each other. In addition, in the following description, the direction Y in which the moving object 2 moves may be referred to as a main scanning direction.

As illustrated in FIG. 1, the liquid ejecting apparatus 1 is provided with the moving object 2, and a moving mechanism 3 that reciprocates the moving object 2 along the direction Y. The moving mechanism 3 includes a carriage motor 31 that is a driving source of the moving object 2, a carriage guide shaft 32 that is fixed at both ends, and a timing belt 33 that extends substantially parallel to the carriage guide shaft 32 and is driven by the carriage motor 31.

A carriage 24 included in the moving object 2 is supported by the carriage guide shaft 32 so as to reciprocate freely, and is fixed to a portion of the timing belt 33. By driving the timing belt 33 by the carriage motor 31, the carriage 24 is guided by the carriage guide shaft 32 and reciprocates along the direction Y. In addition, a head portion 20 having a large number of nozzles is provided in a portion of the moving object 2 that faces the medium P. A control signal or the like is input to the head portion 20 through a cable 190. The head portion 20 ejects an ink as an example of liquid from the nozzle based on the input control signal.

The liquid ejecting apparatus 1 is provided with a transport mechanism 4 that transports the medium P on a platen 40 along the direction X. The transport mechanism 4 is provided with a transport motor 41 as a driving source, and a transport roller 42 that is rotated by the transport motor 41 and transports the medium P along the direction X.

In the liquid ejecting apparatus 1 configured as described above, an image is formed on a surface of the medium P by the head portion 20 ejecting the ink at a timing when the medium P is transported by the transport mechanism 4.

1. 2 Electrical Configuration of Liquid Ejecting Apparatus

Figure 2:
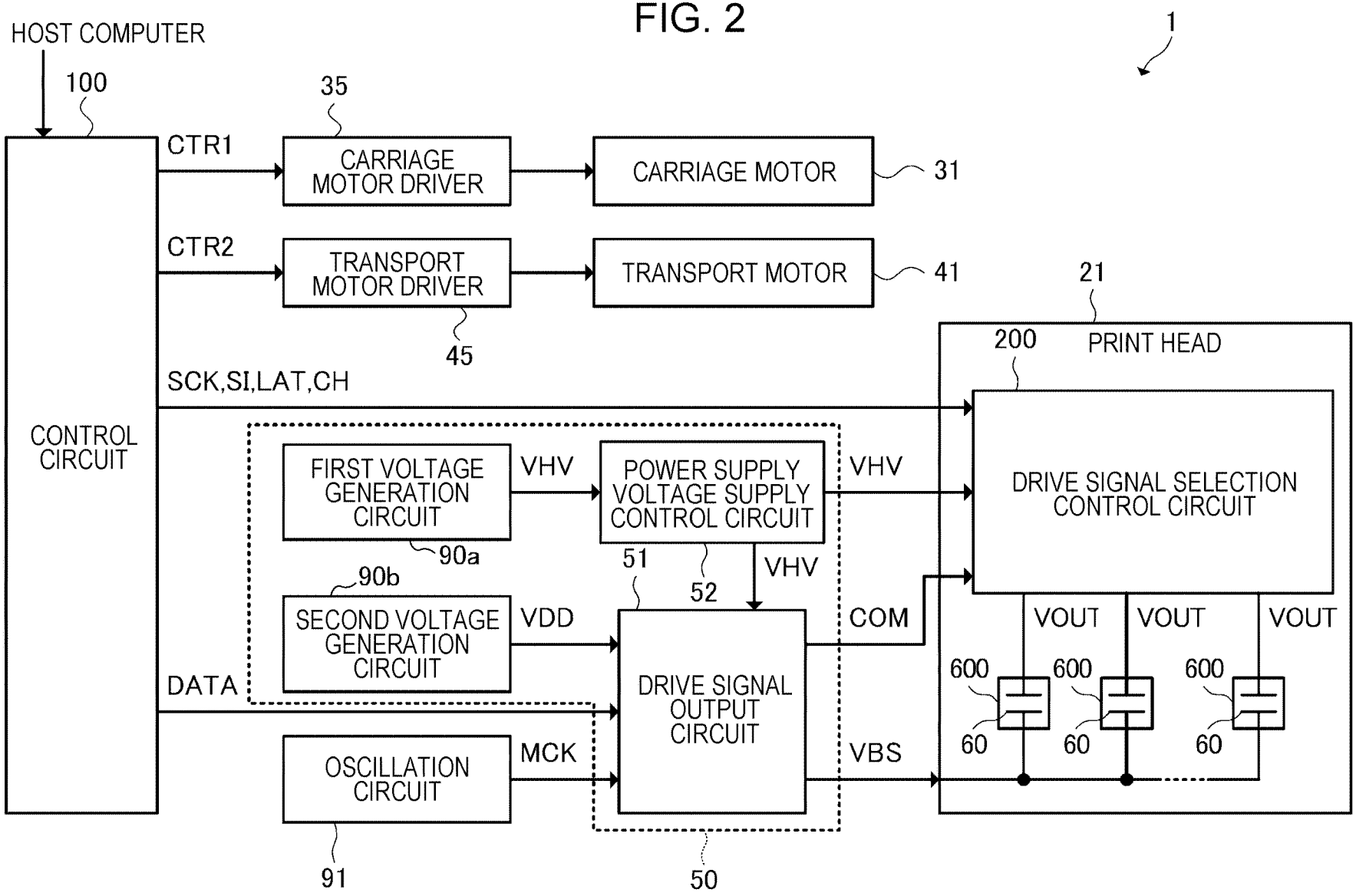
FIG. 2 is a block diagram illustrating an electrical configuration of the liquid ejecting apparatus.

FIG. 2 is a block diagram illustrating an electrical configuration of the liquid ejecting apparatus 1. As illustrated in FIG. 2, the liquid ejecting apparatus 1 includes a control circuit 100, a carriage motor driver 35, a carriage motor 31, a transport motor driver 45, a transport motor 41, a drive circuit 50, an oscillation circuit 91, and a print head 21.

The control circuit 100 generates a plurality of control signals and the like for controlling various components based on the image data input from the host computer, and outputs the control signals to the corresponding components. Specifically, the control circuit 100 supplies a control signal CTR1 to the carriage motor driver 35. The carriage motor driver 35 drives the carriage motor 31 according to the control signal CTR1. As a result, the movement of the carriage 24 in the direction Y illustrated in FIG. 1 is controlled. In addition, the control circuit 100 supplies a control signal CTR2 to the transport motor driver 45. The transport motor driver 45 drives the transport motor 41 in accordance with the control signal CTR2. As a result, the movement of the medium P in the direction X illustrated in FIG. 1 is controlled.

In addition, the control circuit 100 outputs a drive data signal DATA to the drive circuit 50, and also outputs a clock signal SCK, a print data signal SI, a latch signal LAT, a change signal CH, and a drive data signal DATA to the print head 21.

The oscillation circuit 91 outputs a clock signal MCK to the drive circuit 50. Here, the oscillation circuit 91 may have a configuration independent of the control circuit 100 as illustrated in FIG. 2, or may be configured inside the control circuit 100. In addition, the clock signal MCK may be supplied to various components of the liquid ejecting apparatus 1 in addition to the drive circuit 50.

The drive circuit 50 includes a drive signal output circuit 51, a power supply voltage control circuit 70, a first voltage generation circuit 90*a*, and a second voltage generation circuit 90*b*.

The first voltage generation circuit 90*a* generates a voltage signal VHV of, for example, DC 42 V. The first voltage generation circuit 90*a* outputs the voltage signal VHV to the drive circuit 50. In addition, the second voltage generation circuit 90*b* generates a voltage signal VDD of, for example, DC 3.3 V. The second voltage generation circuit 90*b* outputs the voltage signal VDD to the drive circuit 50. The voltage signals VHV and VDD may be supplied to various components of the liquid ejecting apparatus 1 in addition to the drive circuit 50. Here, the first voltage generation circuit 90*a* that outputs the voltage signal VHV is an example of a power supply voltage signal output circuit.

The voltage signal VHV is input to a power supply voltage supply control circuit 52 receives. The power supply voltage supply control circuit 52 controls whether to supply the input voltage signal VHV to the print head 21 and the drive signal output circuit 51.

The drive signal output circuit 51 receives the voltage signals VHV, VDD, the drive data signal DATA, and the clock signal MCK. The drive signal output circuit 51 generates a drive signal COM and a reference voltage signal VBS based on the input voltage signals VHV and VDD, the drive data signal DATA, and the clock signal MCK, and outputs the drive signal COM and the reference voltage signal VBS to the print head 21. Here, the reference voltage signal VBS is a signal having a constant voltage such as a ground potential, DC 5 V, DC 6 V, or the like. The configuration and operation of the drive circuit 50 including the power supply voltage supply control circuit 52 and the drive signal output circuit 51 will be described later in detail.

The print head 21 includes a drive signal selection control circuit 200 and a plurality of ejection portions 600. In addition, each of the ejection portions 600 includes a piezoelectric element 60. A clock signal SCK, a print data signal SI, a latch signal LAT, a change signal CH, a drive signal COM, and a voltage signal VHV are input to the drive signal selection control circuit 200. The drive signal selection control circuit 200 generates a drive signal VOUT and outputs the drive signal VOUT to each ejection portion 600 by selecting or not selecting the drive signal COM based on the clock signal SCK, the print data signal SI, the latch signal LAT, the change signal CH, and the voltage signal VHV.

The drive signal VOUT is supplied to one end of the piezoelectric element 60 included in each of the plurality of ejection portions 600. In addition, the reference voltage signal VBS is supplied to the other end of the piezoelectric element 60. When the piezoelectric element 60 is driven by a potential difference between the drive signal VOUT and the reference voltage signal VBS, the ink is ejected from the ejection portion 600.

As described above, the print head 21 includes the piezoelectric element 60 to which the drive signal VOUT is supplied based on the drive signal COM, and the drive signal selection control circuit 200 that controls the supply of the drive signal VOUT to the piezoelectric element 60. The drive circuit 50 is provided with the power supply voltage supply control circuit 52 that controls the supply of the voltage signal VHV to the drive signal selection control circuit 200 included in the print head 21, the drive signal output circuit 51 that outputs the drive signal COM, and the first voltage generation circuit 90*a* that outputs the voltage signal VHV. That is, the drive circuit 50 drives the print head 21. The print head 21 configured as described above is included in the head portion 20 illustrated in FIG. 1.

Here, the print head 21 is an example of a piezoelectric device, and the voltage signal VHV whose supply to the drive signal selection control circuit 200 of the print head 21 is controlled by the power supply voltage supply control circuit 52 is an example of a power supply voltage signal.

1.3 Configuration and Operation of Liquid Ejecting Head

Next, a configuration and operation of the drive signal selection control circuit 200 will be described. In describing the configuration and operation of the drive signal selection control circuit 200, first, an example of the drive signal COM input to the drive signal selection control circuit 200 will be described with reference to FIG. 3. Thereafter, the configuration and operation of the drive signal selection control circuit 200 will be described with reference to FIGS. 4 to 7.

Figure 3:
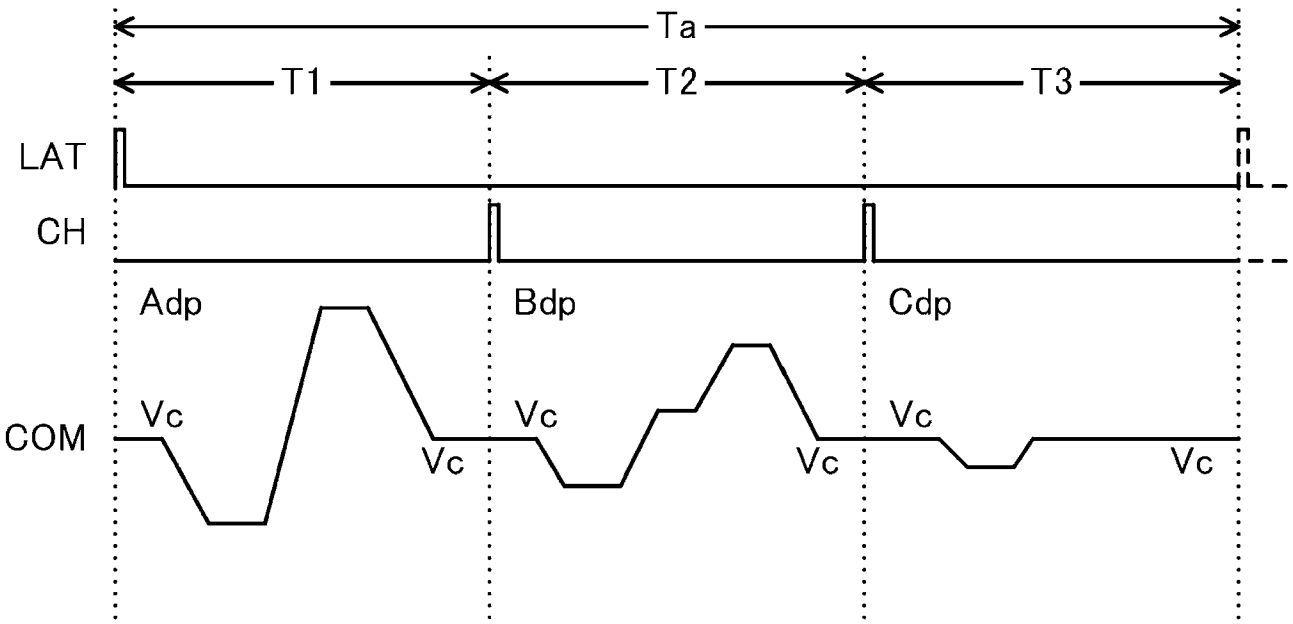
FIG. 3 is a graph illustrating an example of a drive signal COM.

FIG. 3 is a graph illustrating an example of the drive signal COM. FIG. 3 illustrates a period T1 from when the latch signal LAT rises to when the change signal CH rises, a period T2 until the next change signal CH rises after the period T1, and a period T3 until the latch signal LAT rises after the period T2. A cycle formed of the periods T1, T2, and T3 is a cycle Ta for forming a new dot on the medium P. That is, as illustrated in FIG. 3, the latch signal LAT is a signal that defines a cycle in which a new dot is formed on the medium P, and the change signal CH a signal that defines a switching timing of a waveform included in the drive signal COM.

As illustrated in FIG. 3, the drive signal output circuit 51 generates a trapezoidal waveform Adp in the period T1. When the trapezoidal waveform Adp is supplied to the piezoelectric element 60, a predetermined amount, specifically, a medium amount of ink is ejected from the corresponding ejection portion 600. In addition, the drive signal output circuit 51 generates a trapezoidal waveform Bdp in the period T2. When the trapezoidal waveform Bdp is supplied to the piezoelectric element 60, a small amount of ink smaller than the predetermined amount is ejected from the corresponding ejection portion 600. In addition, the drive signal output circuit 51 generates a trapezoidal waveform Cdp in the period T3. When the trapezoidal waveform Cdp is supplied to the piezoelectric element 60, the piezoelectric element 60 is driven to the extent that the ink is not ejected from the corresponding ejection portion 600. Therefore, when the trapezoidal waveform Cdp is supplied to the piezoelectric element 60, no dot is formed on the medium P. This trapezoidal waveform Cdp is a waveform for preventing a viscosity of the ink from increasing by causing the ink in a vicinity of a nozzle opening portion of the ejection portion 600 to vibrate slightly. In the following description, driving the piezoelectric element 60 to such an extent that ink is not ejected from the ejection portion 600 in order to prevent the viscosity of the ink from increasing is referred to as "slight vibration".

Here, a voltage value at the start timing and a voltage value at the end timing of the trapezoidal waveform Adp, the trapezoidal waveform Bdp, and the trapezoidal waveform Cdp are all common to a voltage Vc. That is, the trapezoidal waveforms Adp, Bdp, and Cdp are waveforms that start with the voltage Vc and end with the voltage Vc. Therefore, the drive signal output circuit 51 outputs the drive signal COM having a waveform in which the trapezoidal waveforms Adp, Bdp, and Cdp are continuous in the cycle Ta. The waveform of the drive signal COM illustrated in FIG. 3 is an example, and is not limited to the waveform illustrated in FIG. 3.

Figure 4:
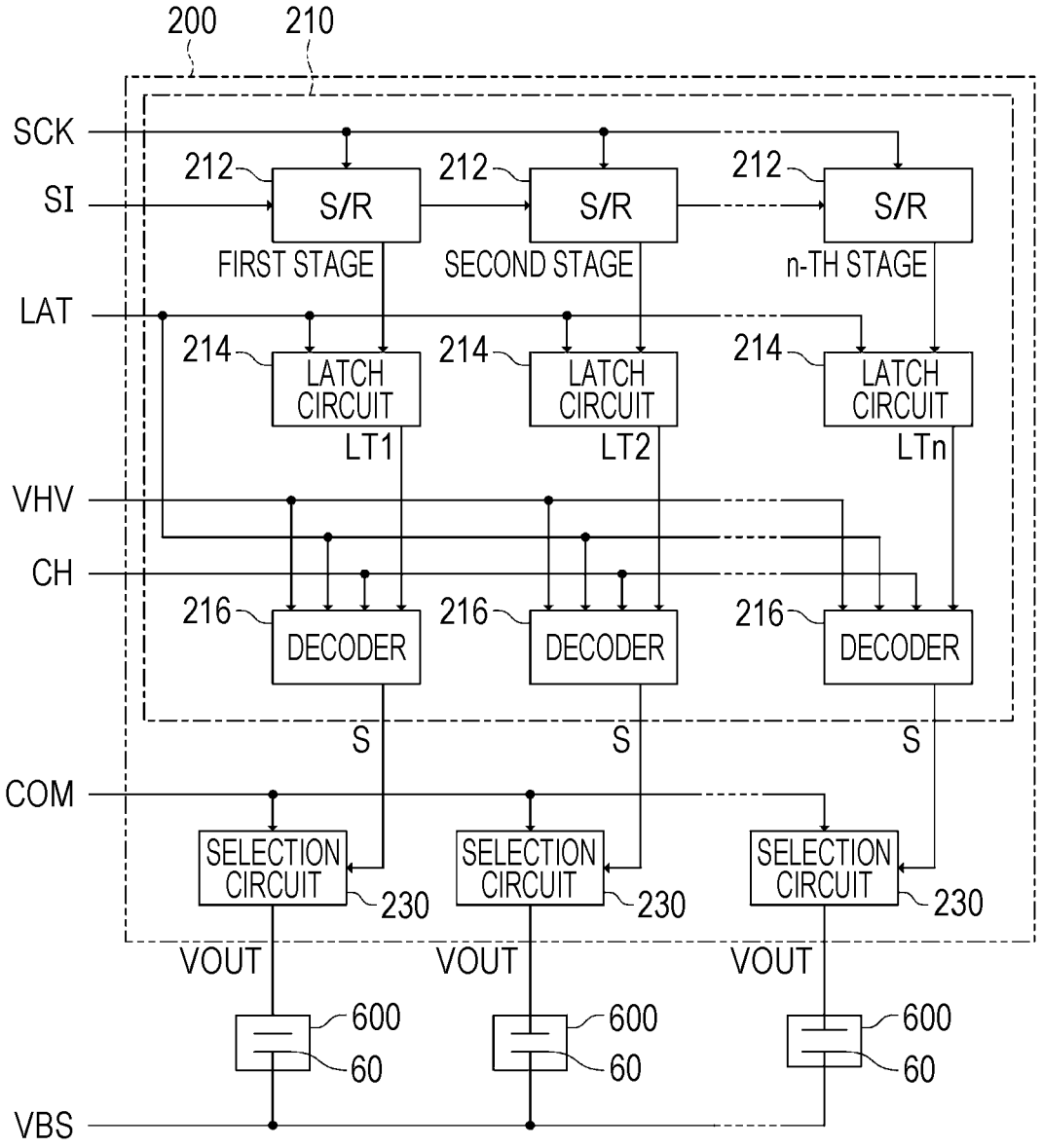
FIG. 4 is a block diagram illustrating an electrical configuration of a drive signal selection control circuit.

FIG. 4 is a block diagram illustrating an electrical configuration of the drive signal selection control circuit 200. The drive signal selection control circuit 200 generates and outputs the drive signal VOUT supplied to the piezoelectric element 60 in the cycle Ta by switching whether or not to select the trapezoidal waveforms Adp, Bdp, and Cdp included in the drive signal COM in each of the periods T1, T2, T3. As illustrated in FIG. 4, the drive signal selection control circuit 200 includes a selection control circuit 210 and a plurality of selection circuits 230.

The selection control circuit 210 is supplied with a clock signal SCK, a print data signal SI, a latch signal LAT, a change signal CH, and a voltage signal VHV. In the selection control circuit 210, a set of a shift register 212 (S/R), a latch circuit 214, and a decoder 216 is provided corresponding to each of the ejection portions 600. That is, the print head 21 is provided with the same number of sets of the shift register 212, the latch circuit 214, and the decoder 216 as the total number n of the ejection portions 600.

The shift register 212 temporarily holds 2-bit print data [SIH, SIL] included in the print data signal SI for each corresponding ejection portion 600. Specifically, the shift register 212 having the number of stages corresponding to the ejection portion 600 are coupled to each other in cascade, and the serially supplied print data signal SI is sequentially transferred to the subsequent stage according to the clock signal SCK. In FIG. 4, in order to distinguish the shift register 212, a first stage, a second stage, . . . , and a n-th stage are indicated in order from the upstream to which the print data signal SI is supplied.

Each of the n latch circuits 214 latches the print data [SIH, SIL] held in the corresponding shift register 212 at the rising edge of the latch signal LAT. Each of the n decoders 216 decodes the 2-bit print data [SIH, SIL] latched by the corresponding latch circuit 214 to generate a selection signal S and supplies the selection signal S to the selection circuit 230.

The selection circuit 230 is provided corresponding to each of the ejection portions 600. That is, the number of the selection circuits 230 included in one print head 21 is the same as the total number n of the ejection portions 600 included in the print head 21. The selection circuit 230 controls the supply of the drive signal COM to the piezoelectric element 60 based on the selection signal S supplied from the decoder 216.

Figures 5, 6:
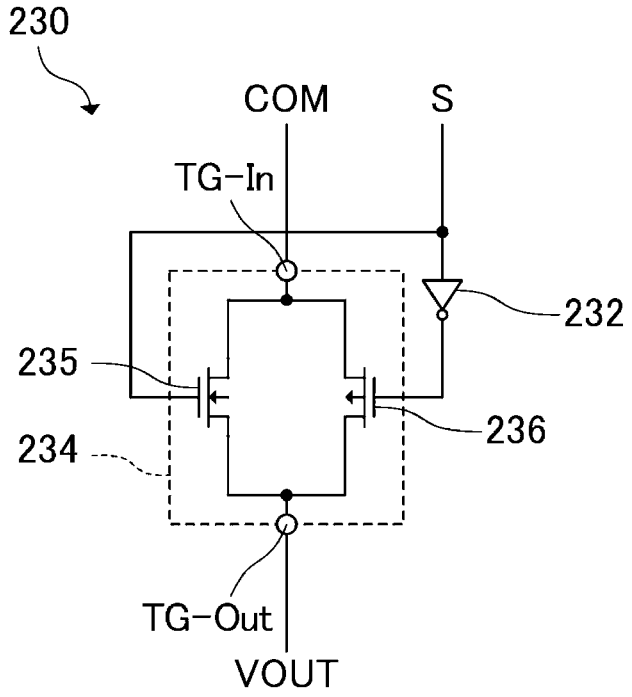
FIG. 5 is a circuit diagram illustrating an electrical configuration of a selection circuit corresponding to one ejection portion.
FIG. 6 is a table illustrating decoding contents in a decoder.

FIG. 5 is a circuit diagram illustrating an electrical configuration of the selection circuit 230 corresponding to one ejection portion 600. As illustrated in FIG. 5, the selection circuit 230 includes an inverter 232 and a transfer gate 234. In addition, the transfer gate 234 includes a transistor 235 that is an NMOS transistor and a transistor 236 that is a PMOS transistor.

The selection signal S is supplied from the decoder 216 to a gate terminal of the transistor 235. In addition, the selection signal S is logically inverted by the inverter 232 and is also supplied to the gate terminal of the transistor 236. A drain terminal of the transistor 235 and a source terminal of the transistor 236 are coupled to a terminal TG-In which is one end of the transfer gate 234. The drive signal COM is input to the terminal TG-In of the transfer gate 234. When the transistor 235 and the transistor 236 are controlled to be turned on or off in accordance with the selection signal S, the drive signal VOUT is output from a terminal TG-Out which is the other end of the transfer gate 234 to which the source terminal of the transistor 235 and the drain terminal of the transistor 236 are commonly coupled. The terminal TG-Out of the transfer gate 234 to which the drive signal VOUT is output is electrically coupled to an electrode 611 of the piezoelectric element 60 described later. In the following description, the case where the transistor 235 and the transistor 236 are controlled to be conductive may be referred to as "on", and the case where the transistor 235 and the transistor 236 are controlled to be non-conductive may be referred to as "off".

Next, the decoding contents of the decoder 216 will be described with reference to FIG. 6. FIG. 6 is a table illustrating decoding contents in the decoder 216. The 2-bit print data [SIH, SIL], the latch signal LAT, and the change signal CH are input to the decoder 216. For example, when the print data [SIH, SIL] is [1, 0] that defines "medium dot", the decoder 216 outputs a selection signal S that is H, L, and L level in the periods T1, T2, and T3. Here, the logic level of the selection signal S is level-shifted to a high amplitude logic based on the voltage signal VHV by a level shifter (not illustrated).

Figure 7:
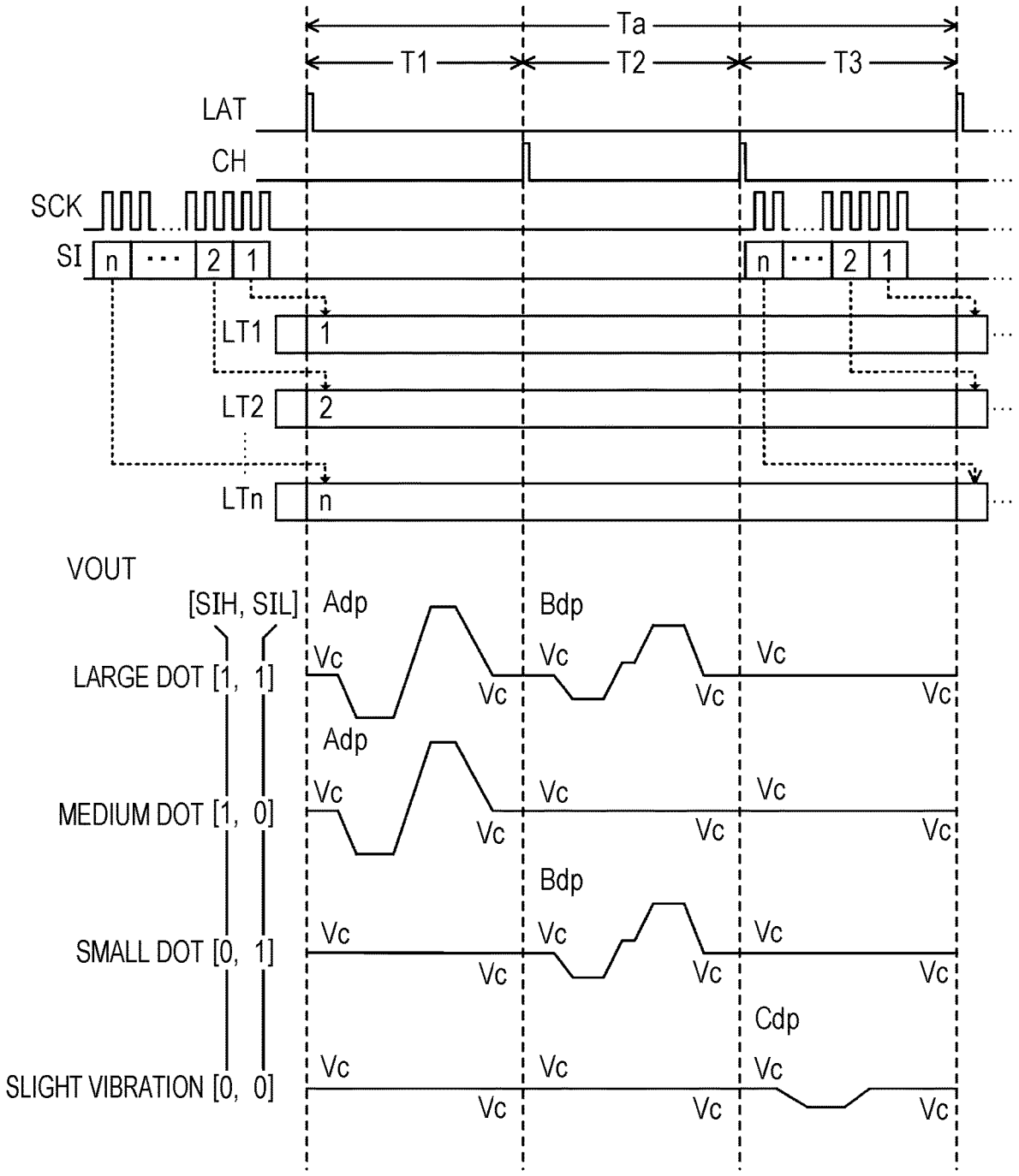
FIG. 7 is a graph for describing an operation of the drive signal selection control circuit.

FIG. 7 is a graph for describing an operation of the drive signal selection control circuit 200. As illustrated in FIG. 7, the print data signal SI is serially supplied to the drive signal selection control circuit 200 in synchronization with the clock signal SCK, and is sequentially transferred in the shift register 212 corresponding to the ejection portion 600. When the supply of the clock signal SCK is stopped, the print data [SIH, SIL] corresponding to the ejection portion 600 is held in each of the shift registers 212. The print data signal SI is supplied in order corresponding to a final n stage, . . . , a second stage, and a first stage ejection portions 600 in the shift register 212.

Here, when the latch signal LAT rises, each of the latch circuits 214 latches simultaneously the print data [SIH, SIL] held in the corresponding shift register 212. LT1, LT2, . . . , LTn illustrated in FIG. 7 are the print data [SIH, SIL] latched by the latch circuit 214 corresponding to a first stage, a second stage, . . . , and a n-th stage shift register 212.

The decoder 216 outputs a logic level selection signal S according to the contents illustrated in FIG. 6 in each of the periods T1, T2, and T3 in accordance with the dot size defined by the latched print data [SIH, SIL].

When the print data [SIH, SIL] is [1, 1], the selection circuit 230 selects the trapezoidal waveform Adp in the period T1, the trapezoidal waveform Bdp in the period T2, and does not select the trapezoidal waveform Cdp in the period T3, according to the selection signal S. As a result, the drive signal VOUT corresponding to the large dot illustrated in FIG. 7 is generated. Therefore, a medium amount of ink and a small amount of ink are ejected from the ejection portion 600. Therefore, the large dots are formed on the medium P by combining the ink. In addition, when the print data [SIH, SIL] is [1, 0], the selection circuit 230 selects the trapezoidal waveform Adp in the period T1, does not select the trapezoidal waveform Bdp in the period T2, and does not select the trapezoidal waveform Cdp in the period T3, according to the selection signal S. As a result, the drive signal VOUT corresponding to the medium dot illustrated in FIG. 7 is generated. Therefore, a medium amount of ink is ejected from the ejection portion 600. Therefore, the medium dots are formed on the medium P. In addition, when the print data [SIH, SIL] is [0, 1], the selection circuit 230 does not select the trapezoidal waveform Adp in the period T1, selects the trapezoidal waveform Bdp in the period T2, and does not select the trapezoidal waveform Cdp in the period T3, according to the selection signal S. As a result, the drive signal VOUT corresponding to the small dot illustrated in FIG. 7 is generated. Therefore, a small amount of ink is ejected from the ejection portion 600. Therefore, the small dots are formed on the medium P. In addition, when the print data [SIH, SIL] is [0, 0], the selection circuit 230 does not select the trapezoidal waveform Adp in the period T1, does not select the trapezoidal waveform Bdp in the period T2, and selects the trapezoidal waveform Cdp in the period T3, according to the selection signal S. As a result, the drive signal VOUT corresponding to the slight vibration illustrated in FIG. 7 is generated. Therefore, the ink is not ejected from the ejection portion 600, and slight vibrations occur.

That is, the drive signal VOUT is generated by selecting the trapezoidal waveform included in the drive signal COM output from the drive signal output circuit 51. Therefore, the drive signal COM and the drive signal VOUT are both signals for driving the piezoelectric element 60 and are also signals output from the drive signal output circuit 51. That is, at least one of the drive signal VOUT and the drive signal COM is an example of a drive signal.

Figure 8:
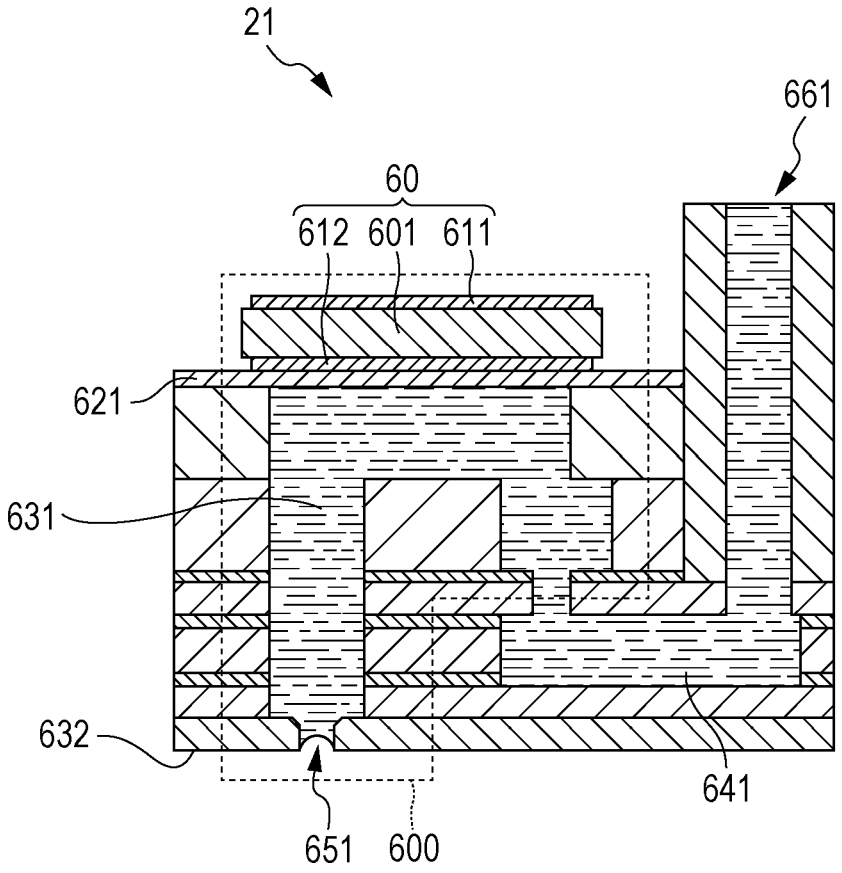
FIG. 8 is a cross-sectional view illustrating a schematic configuration of an ejection portion.

Here, the configuration and operation of the ejection portion 600 including the piezoelectric element 60 will be described with reference to FIG. 8. FIG. 8 is a cross-sectional view illustrating a schematic configuration of the ejection portion 600 when the print head 21 is cut so as to include the ejection portion 600.

As illustrated in FIG. 8, the print head 21 includes the ejection portion 600 and a reservoir 641. The ink is introduced into the reservoir 641 from a supply port 661. In addition, the reservoir 641 is provided for each ink color.

The ejection portion 600 includes the piezoelectric element 60, a diaphragm 621, a cavity 631, and a nozzle 651. The diaphragm 621 is provided between the cavity 631 and the piezoelectric element 60. The diaphragm 621 is displaced when the piezoelectric element 60 provided on the upper surface is driven. That is, the diaphragm 621 functions as a diaphragm that expands and reduces an internal volume of the cavity 631 by being displaced. The inside of the cavity 631 is filled with the ink. In addition, the cavity 631 functions as a pressure chamber whose internal volume changes by driving the piezoelectric element 60. The nozzle 651 is an opening portion provided in the nozzle plate 632 and communicating with the cavity 631.

The piezoelectric element 60 has a structure in which a piezoelectric body 601 is interposed between a pair of electrodes 611 and 612. The drive signal VOUT is supplied to the electrode 611, and the reference voltage signal VBS is supplied to an electrode 612. The piezoelectric element 60 having such a structure is driven according to the potential difference between the electrode 611 and the electrode 612. As the piezoelectric element 60 is driven, the central portions of the electrodes 611 and 612 and the diaphragm 621 are displaced in a vertical direction with respect to both end portions. When the internal volume of the cavity 631 changes with the displacement of the diaphragm 621, the ink filled in the cavity 631 is ejected from the nozzle 651.

1.4 Configuration and Operation of Drive Circuit

Figure 9:
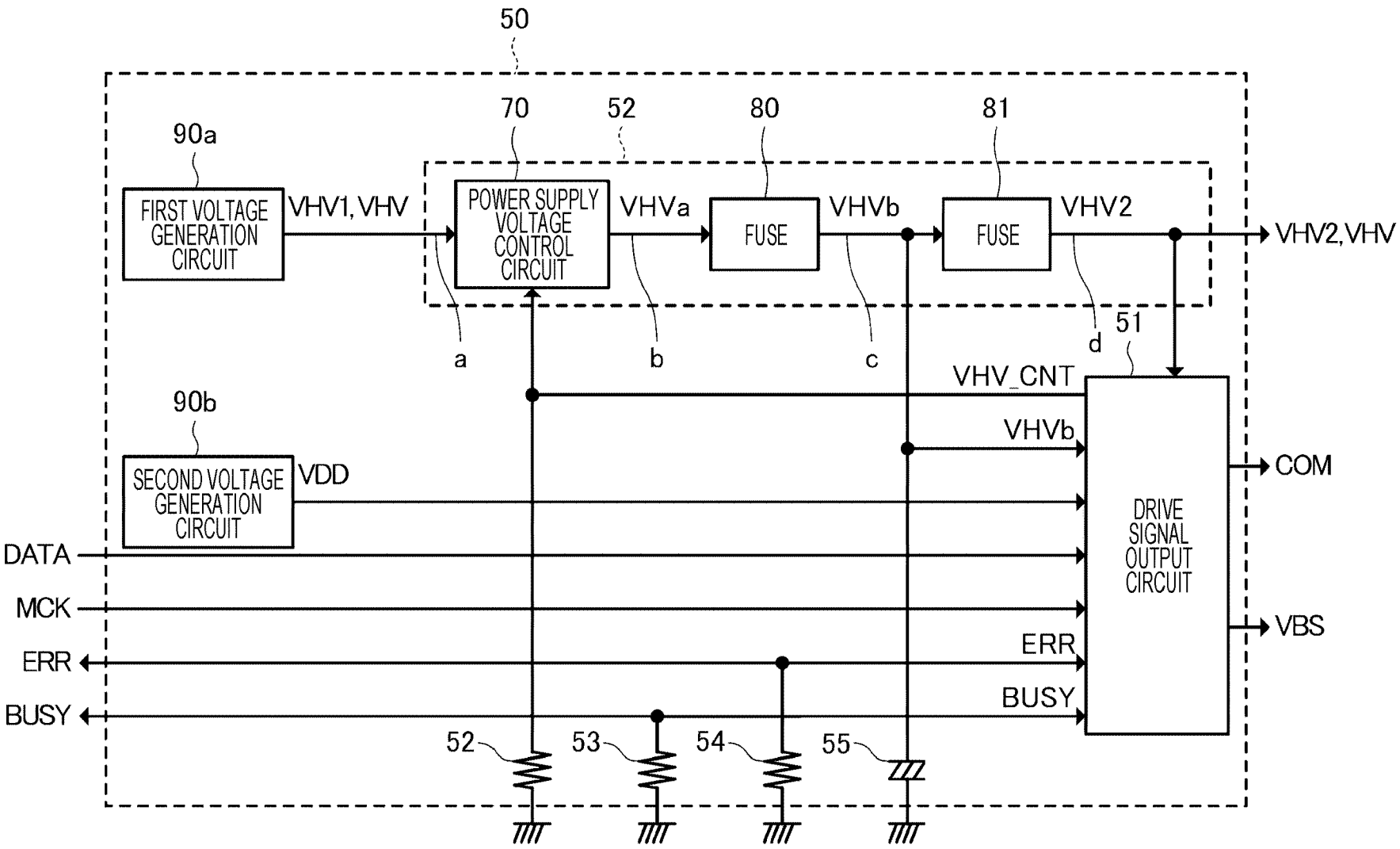
FIG. 9 is a block diagram illustrating a configuration of a drive circuit.

Next, a configuration and operation of the drive circuit 50 will be described. FIG. 9 is a block diagram illustrating a configuration of the drive circuit 50. As illustrated in FIG. 9, the drive circuit 50 includes a power supply voltage supply control circuit 52, a drive signal output circuit 51, a first voltage generation circuit 90*a*, and a second voltage generation circuit 90*b*. The drive circuit 50 outputs various signals for driving the print head 21. In other words, the drive circuit 50 drives the print head 21. In the following description, the voltage signal VHV output from the first voltage generation circuit 90*a* to the power supply voltage supply control circuit 52 may be referred to as a voltage signal VHV1. The voltage signal VHV output from the power supply voltage supply control circuit 52 and input to the print head 21 may be referred to as a voltage signal VHV2.

The power supply voltage supply control circuit 52 includes a power supply voltage control circuit 70 and fuses 80 and 81. The voltage signal VHV1 input to the power supply voltage supply control circuit 52 propagates along a propagation path a and is input to the power supply voltage control circuit 70 of the power supply voltage supply control circuit 52. The power supply voltage control circuit 70 controls whether or not to output the input voltage signal VHV1 as a voltage signal VHVa. The voltage signal VHVa output from the power supply voltage control circuit 70 propagates along a propagation path b and is input to fuse 80. The fuse 80 outputs the input voltage signal VHVa as a voltage signal VHVb. The voltage signal VHVb propagates along a propagation path c and is input to fuse 81. The fuse 81 outputs the input voltage signal VHVb as a voltage signal VHV2. The voltage signal VHV2 propagates along a propagation path d and is output from drive circuit 50. The voltage signal VHV2 output from the drive circuit 50 is input to the drive signal selection control circuit 200 included in the print head 21. That is, the power supply voltage control circuit 70 is electrically coupled to the drive signal selection control circuit 200 and controls the supply of the voltage signal VHV to the drive signal selection control circuit 200. The propagation paths a, b, c, and d may be, for example, wiring patterns on a circuit substrate on which the drive circuit 50 is mounted, or wiring patterns inside an integrated circuit.

In addition, the voltage signal VHVb is branched on the propagation path c. One of the branched voltage signals VHVb is input to the fuse 81, and the other of the branched voltage signals VHVb is input to the drive signal output circuit 51. Similarly, the voltage signal VHV2 is branched on the propagation path d. One of the branched voltage signals VHV2 is input to the print head 21, and the other of the branched voltage signals VHV2 is input to the drive signal output circuit 51. That is, the drive signal output circuit 51 receives the voltage signal VHVb from which the voltage signal VHVa output from the power supply voltage control circuit 70 is output through the fuse 80, and the voltage signal VHV2 from which the voltage signal VHVa output from the power supply voltage control circuit 70 is output through the fuses 80 and 81.

In addition, the drive signal output circuit 51 receives the voltage signal VDD output from the second voltage generation circuit 90*b*, the clock signal MCK output from the oscillation circuit 91, and the drive data signal DATA output from the control circuit 100. Furthermore, an error signal ERR and a status signal BUSY are mutually propagated between the drive signal output circuit 51 and the control circuit 100.

Figure 10:
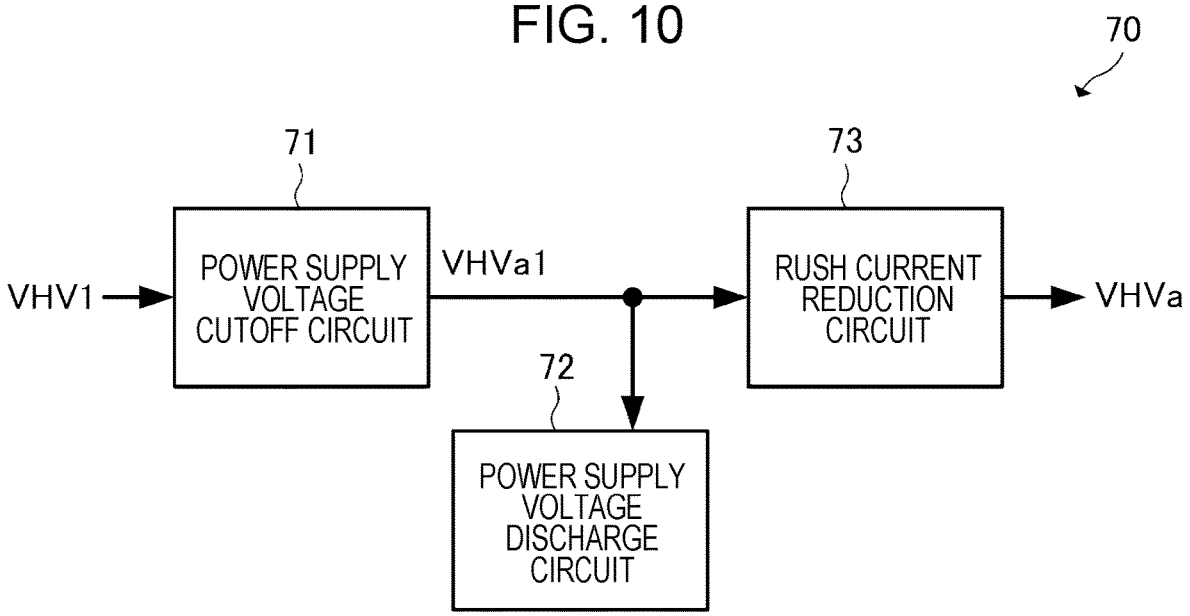
FIG. 10 is a diagram illustrating a configuration of a power supply voltage control circuit.

Here, the configuration and operation of the drive signal output circuit 51 and the power supply voltage control circuit 70 included in the drive circuit 50 will be described. FIG. 10 is a diagram illustrating a configuration of the power supply voltage control circuit 70. As illustrated in FIG. 10, the power supply voltage control circuit 70 includes a power supply voltage cutoff circuit 71, a power supply voltage discharge circuit 72, and a rush current reduction circuit 73. The voltage signal VHV1 propagates through the propagation path a and is input to power supply voltage cutoff circuit 71. The power supply voltage cutoff circuit 71 controls whether to supply the input voltage signal VHV1 as a voltage signal VHVa1 to the rush current reduction circuit 73 or to cut off the voltage signal VHV1. The rush current reduction circuit 73 limits a rush current generated when the supply of the voltage signal VHVa1 is started from the state where the supply of the voltage signal VHVa1 is cut off in the power supply voltage cutoff circuit 71. In other words, the rush current reduction circuit 73 reduces the possibility of generating a large rush current based on the voltage signal VHVa output from the power supply voltage control circuit 70. The power supply voltage discharge circuit 72 is electrically coupled to a wiring to which the power supply voltage cutoff circuit 71 and the rush current reduction circuit 73 are electrically coupled. The power supply voltage discharge circuit 72 controls the discharge of the charge stored in the path to which the voltage signal VHVa1 output from the power supply voltage cutoff circuit 71 is supplied.

Figure 11:
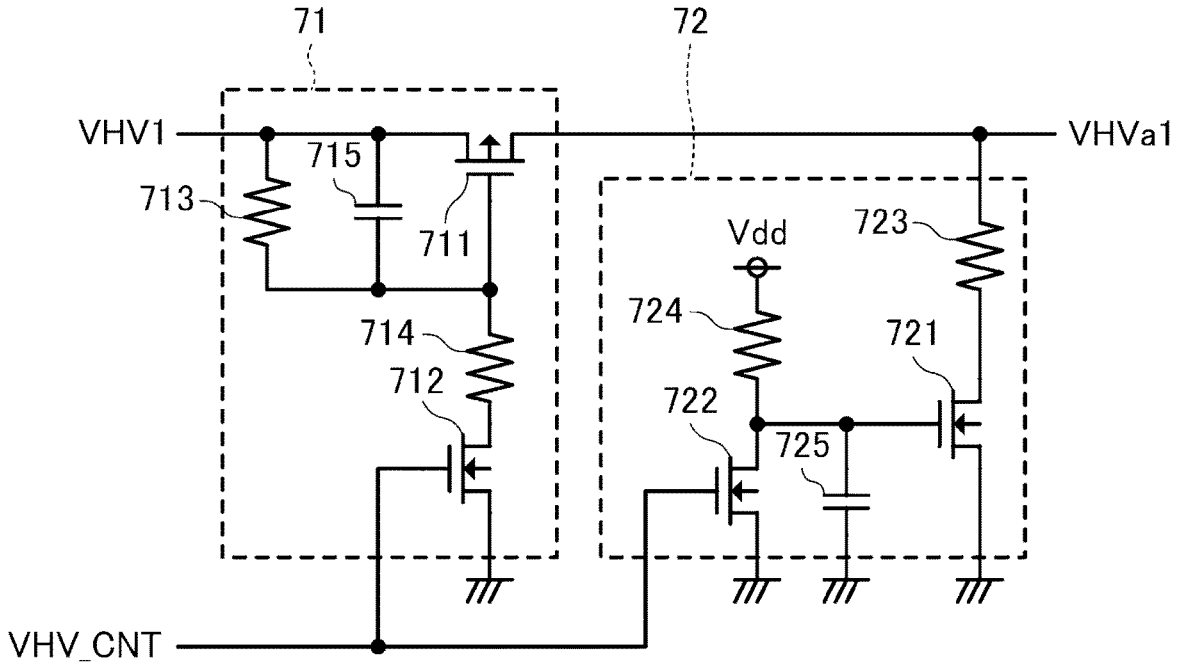
FIG. 11 is a diagram illustrating a configuration of a power supply voltage cutoff circuit and a power supply voltage discharge circuit.

FIG. 11 is a diagram illustrating a configuration of the power supply voltage cutoff circuit 71 and the power supply voltage discharge circuit 72. As illustrated in FIG. 11, the power supply voltage cutoff circuit 71 includes transistors 711 and 712, resistors 713 and 714, and a capacitor 715. Here, the transistor 711 in the present embodiment is a PMOS transistor, and the transistor 712 is an NMOS transistor.

The voltage signal VHV1 is input to a source terminal of the transistor 711. The voltage signal VHV1 is output from a drain terminal of the transistor 711 as a voltage signal VHVa1. In other words, the power supply voltage control circuit 70 includes the transistor 711 provided on the path through which the voltage signal VHV propagates. When the transistor 711 functions as a switch element, switching between outputting the voltage signal VHV1 as the voltage signal VHVa1 and cutting off the voltage signal VHV1 is performed. In addition, a gate terminal of the transistor 711 is coupled to one end of the resistor 713, one end of the resistor 714, and one end of the capacitor 715.

The voltage signal VHV1 is input to the other end of the resistor 713 and the other end of the capacitor 715. That is, the resistor 713 and the capacitor 715 are provided in parallel between the source terminal and the gate terminal of the transistor 711. The other end of the resistor 714 is coupled to the drain terminal of the transistor 712. The source terminal of the transistor 712 is coupled to the ground. In addition, a VHV control signal VHV_CNT is input to the gate terminal of the transistor 712.

When a VHV control signal VHV_CNT at an H level is input to the power supply voltage cutoff circuit 71 configured as described above, the transistor 712 is controlled to be turned on. When the transistor 712 is controlled to be turned on, the transistor 711 is controlled to be turned on. As a result, the source terminal and the drain terminal of the transistor 711 conduct, and the voltage signal VHV1 is output as the voltage signal VHVa1. On the other hand, when a VHV control signal VHV_CNT at an L level is input to the power supply voltage cutoff circuit 71, the transistor 712 is controlled to be turned off. When the transistor 712 is controlled to be turned off, the transistor 711 is controlled to be turned off. As a result, the source terminal and the drain terminal of the transistor 711 are electrically cut off. Therefore, the voltage signal VHVa1 is cut off. That is, the power supply voltage cutoff circuit 71 including the transistor 711 controls whether the voltage signal VHV is propagated as the voltage signal VHVa1 or cut off based on the logical level of the VHV control signal VHV_CNT. In other words, the power supply voltage control circuit 70 including the power supply voltage cutoff circuit 71 controls the supply of the voltage signal VHV to the print head 21. As described above, the power supply voltage cutoff circuit 71 including the transistor 711 functions as a voltage limitation circuit that limits the supply of the voltage signal VHV1 to the print head 21.

The power supply voltage discharge circuit 72 includes transistors 721 and 722, resistors 723 and 724, and a capacitor 725. Here, the transistors 721 and 722 in the present embodiment are both NMOS transistors.

One end of the resistor 723 is coupled to a wiring through which the voltage signal VHVa1 is propagated, and the other end of the resistor 723 is coupled to a drain terminal of the transistor 721. The source terminal of the transistor 721 is coupled to the ground. The gate terminal of the transistor 721 is coupled to one end of the resistor 724, one end of the capacitor 725, and the drain terminal of the transistor 722. The voltage signal VDD is supplied to the other end of the resistor 724. The other end of the capacitor 725 and the source terminal of the transistor 722 are coupled to the ground. The VHV control signal VHV_CNT is input to the gate terminal of the transistor 722.

As described above, the power supply voltage discharge circuit 72 is electrically coupled to the wiring that electrically couples the power supply voltage cutoff circuit 71 and the rush current reduction circuit 73 to each other. The power supply voltage discharge circuit 72 controls the discharge of the stored charge based on the voltage signal VHV according to the logic level of the VHV control signal VHV_CNT. Specifically, when the VHV control signal VHV_CNT at the H level is input to the power supply voltage discharge circuit 72, the transistor 722 is controlled to be turned on. When the transistor 722 is turned on, the transistor 721 is controlled to be turned off. At this time, the power supply voltage discharge circuit 72 does not discharge the charge based on the voltage signal VHV. On the other hand, when the VHV control signal VHV_CNT at the L level is input to the power supply voltage discharge circuit 72, the transistor 722 is controlled to be turned off. When the transistor 722 is turned off, the voltage signal VDD is supplied to the gate terminal of the transistor 721. Therefore, the transistor 721 is controlled to be turned on. At this time, the power supply voltage discharge circuit 72 discharges the charge stored by the voltage based on the voltage signal VHVa1 as the voltage signal VHV propagated through the propagation path b through the rush current reduction circuit 73.

As described above, the power supply voltage cutoff circuit 71 and the power supply voltage discharge circuit 72 switch between outputting the voltage signal VHV1 to the rush current reduction circuit 73 based on the logic level of the VHV control signal VHV_CNT or discharging the stored charge based on the voltage signal VHVa1. Specifically, when the VHV control signal VHV_CNT at the H level is input to the power supply voltage control circuit 70, the transistor 711 is controlled to be turned on and the transistor 721 is controlled to be turned off. As a result, the voltage signal VHV1 supplied to the propagation path a is input to the rush current reduction circuit 73 through the transistor 711 as the voltage signal VHVa1. On the other hand, when the VHV control signal VHV_CNT at the L level is supplied to the power supply voltage control circuit 70, the transistor 711 is controlled to be turned off and the transistor 721 is controlled to be turned on. As a result, the voltage signal VHV1 supplied to the propagation path a is cut off by the transistor 711, and the charge stored based on the voltage signal VHVa1 is discharged through the transistor 721.

Figure 12:
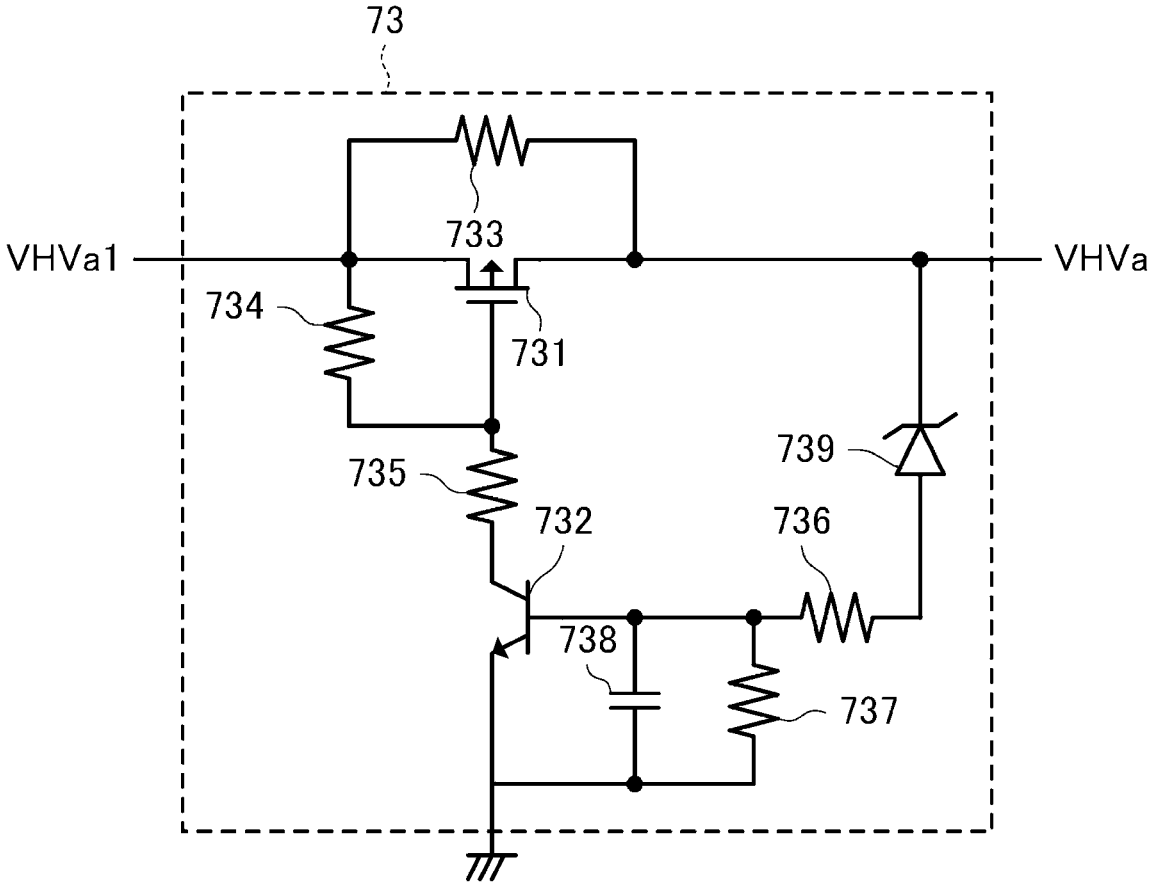
FIG. 12 is a diagram illustrating a configuration of a rush current reduction circuit.

FIG. 12 is a diagram illustrating a configuration of the rush current reduction circuit 73. As illustrated in FIG. 12, the rush current reduction circuit 73 includes transistors 731 and 732, resistors 733, 734, 735, 736, 737, a capacitor 738, and a constant voltage diode 739. Here, the transistor 731 in the present embodiment is a PMOS transistor, and the transistor 732 is an N-type bipolar transistor.

The voltage signal VHVa1 is input to a source terminal of the transistor 731. The voltage signal VHVa1 is output from the drain terminal of the transistor 731 as a voltage signal VHVa. In addition, the gate terminal of the transistor 731 is coupled to one end of the resistor 734 and one end of the resistor 735. The voltage signal VHVa1 is input to the other end of the resistor 734. That is, the resistor 734 is provided in parallel between the source terminal and the gate terminal of the transistor 731. In addition, the resistor 733 has one end coupled to the source terminal of the transistor 731 and the other end coupled to the drain terminal of the transistor 731.

The other end of the resistor 735 is coupled to a collector terminal of the transistor 732. An emitter terminal of the transistor 732 is coupled to the ground. In addition, a base terminal of the transistor 732 is coupled to one end of the resistor 736, one end of the resistor 737, and one end of the capacitor 738. The other end of the resistor 737 and the other end of the capacitor 738 are coupled to the ground. That is, the resistor 737 and the capacitor 738 are provided in parallel between the base terminal and the emitter terminal of the transistor 732.

The other end of the resistor 736 is coupled to an anode terminal of the constant voltage diode 739. The voltage signal VHVa is input to a cathode terminal of the constant voltage diode 739.

In the rush current reduction circuit 73 configured as described above, when the supply of the voltage signal VHVa1 is cut off in the power supply voltage cutoff circuit 71, the voltage signal VHVa1 is not input. Therefore, the rush current reduction circuit 73 does not output the voltage signal VHVa. Since the voltage signal VHVa is not output, the potential of the anode terminal of the constant voltage diode 739 becomes the ground potential through the resistor 737. Therefore, the transistor 732 is controlled to be turned off, and the transistor 731 is also controlled to be turned off.

When the supply of the voltage signal VHVa1 is started in a state where the supply of the voltage signal VHVa1 is cut off in the power supply voltage cutoff circuit 71, the voltage signal VHVa1 is input to the rush current reduction circuit 73. In this case, the transistor 731 is controlled to be turned off. Therefore, the voltage signal VHVa1 is propagated to the drain terminal of the transistor 731 through the resistor 733 as the voltage signal VHVa. At this time, the current generated due to the voltage signal VHVa1 and the voltage signal VHVa is limited by the resistor 733. Therefore, the possibility that a large rush current is generated is reduced.

When a predetermined period elapses after the input of the voltage signal VHVa1 to the rush current reduction circuit 73 starts, the voltage value of the voltage signal VHVa increases. Specifically, the voltage signal VHVa1 input to the rush current reduction circuit 73 is input to a capacitor 55 through the resistor 733 and the fuse 80. As a result, charges are stored in the capacitor 55. Therefore, the voltage value of voltage signal VHVa increases. When the voltage value of voltage signal VHVa is a predetermined value or higher defined by the constant voltage diode 739, the voltage value of the anode terminal of constant voltage diode 739 increases. When the voltage value of the anode terminal of the constant voltage diode 739 exceeds a threshold voltage of the transistor 732, the transistor 732 is controlled to be turned on. As the transistor 732 is controlled to be turned on, the transistor 731 is controlled to be turned on. As a result, the voltage signal VHVa1 is propagated to the drain terminal as the voltage signal VHVa through the transistor 731 and is output from the power supply voltage control circuit 70.

In the rush current reduction circuit 73 configured as described above, immediately after the supply of the voltage signal VHVa1 is started from the state where the supply of the voltage signal VHVa1 is cut off, the voltage signal VHVa1 propagates to the drain terminal of the transistor 731 through the resistor 733. As a result, it is possible to reduce the possibility that a large rush current may occur. In addition, when the voltage value of the voltage signal VHVa is a predetermined value or higher defined by the constant voltage diode 739, the transistor 731 is controlled to be turned on. As a result, it possible to reduce the power loss in the rush current reduction circuit 73.

Returning to FIG. 9, the voltage signal VHVa output from the power supply voltage control circuit 70 is input to the drive signal output circuit 51 through the fuse 80 as the voltage signal VHVb, and is input to the drive signal output circuit 51 through the fuses 80 and 81 as the voltage signal VHV2.

Figure 13:
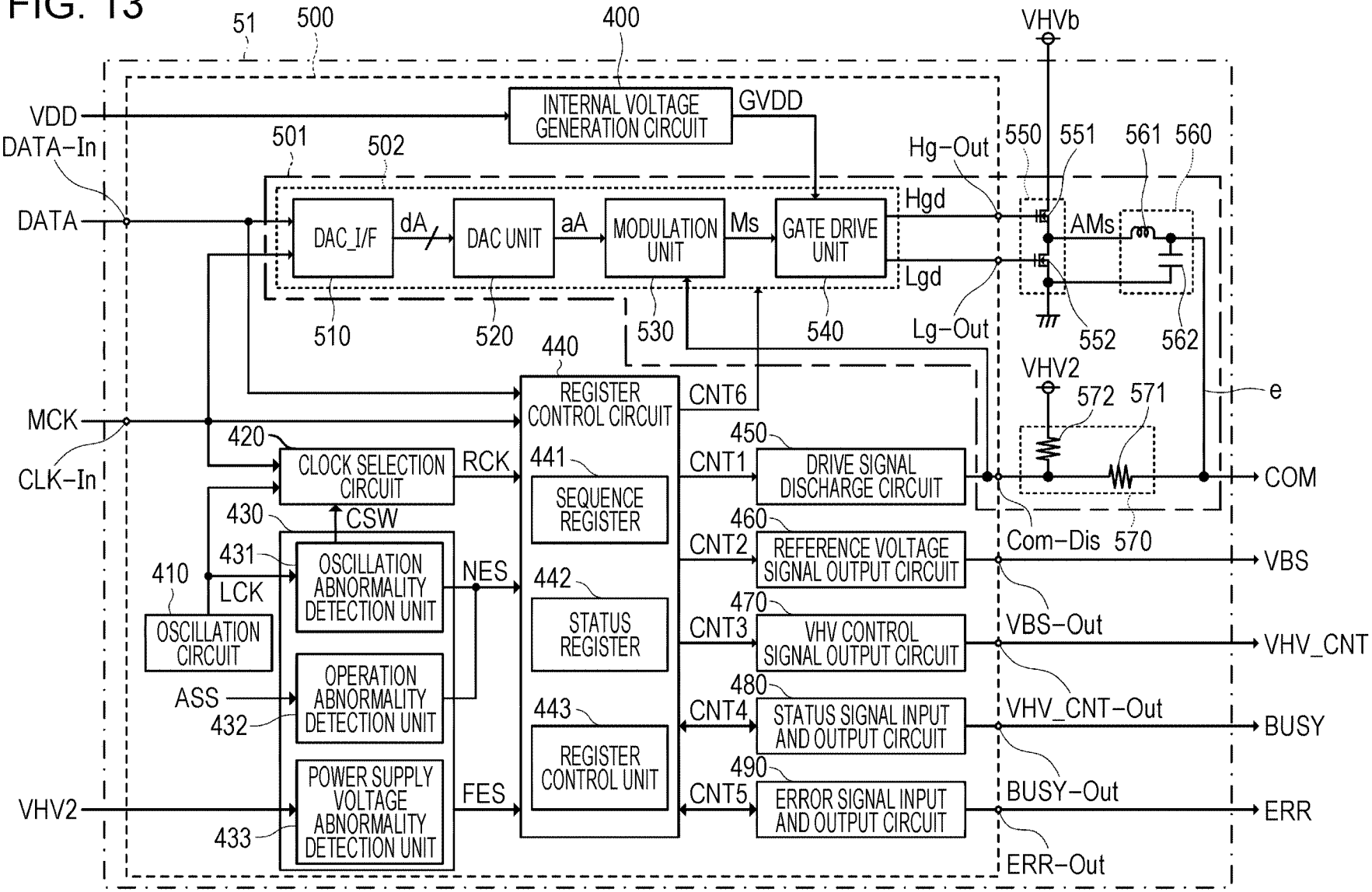
FIG. 13 is a diagram illustrating a configuration of a drive signal output circuit.

Next, a configuration and operation of the drive signal output circuit 51 will be described with reference to FIG. 13. FIG. 13 is a diagram illustrating a configuration of the drive signal output circuit 51. The drive signal output circuit 51 includes an integrated circuit 500, an amplification circuit 550, a demodulation circuit 560, and a feedback circuit 570.

The integrated circuit 500 includes an amplification control signal generation circuit 502, an internal voltage generation circuit 400, an oscillation circuit 410, a clock selection circuit 420, an abnormality detection circuit 430, a register control circuit 440, a drive signal discharge circuit 450, a reference voltage signal output circuit 460, a VHV control signal output circuit 470, a status signal input and output circuit 480, and an error signal input and output circuit 490.

The voltage signal VDD is supplied to the internal voltage generation circuit 400. The internal voltage generation circuit 400 generates, for example, a voltage signal GVDD of DC 7.5 V by boosting the input voltage signal VDD. The voltage signal GVDD is input to various components of the integrated circuit 500 including a gate drive portion 540 described below.

The amplification control signal generation circuit 502 generates amplification control signals Hgd and Lgd based on a data signal that defines the waveform of the drive signal COM included in the drive data signal DATA input from a terminal DATA-In. The amplification control signal generation circuit 502 includes a digital to analog converter interface (DAC interface: DAC_I/F) 510, a DAC portion 520, a modulation portion 530, and a gate drive portion 540.

The DAC interface 510 receives the drive data signal DATA supplied from the terminal DATA-In and the clock signal MCK supplied from a terminal MCK-In. The DAC interface 510 integrates the drive data signal DATA based on the clock signal MCK, and generates, for example, 10-bit drive data dA that defines the waveform of the drive signal COM. The drive data dA is input to the DAC portion 520. The DAC portion 520 converts the input drive data dA into an original drive signal aA of an analog signal. The original drive signal aA is a target signal before amplification of the drive signal COM. The original drive signal aA is input to the modulation portion 530. The modulation portion 530 outputs a modulation signal Ms obtained by performing pulse width modulation on the original drive signal aA. The gate drive portion 540 receives the voltage signals VHV and GVDD and the modulation signal Ms. The gate drive portion 540 amplifies the input modulation signal Ms based on the voltage signal GVDD, inverts the logic level of an amplification control signal Hgd level-shifted to high amplitude logic based on the voltage signal VHV and the input modulation signal Ms, and generates an amplification control signal Lgd amplified based on the voltage signal GVDD. That is, the amplification control signal Hgd and the amplification control signal Lgd are mutually exclusive at the H level. The amplification control signal Hgd is output from the integrated circuit 500 through a terminal Hg-Out, and is input to the amplification circuit 550. Similarly, the amplification control signal Lgd is output from the integrated circuit 500 through a terminal Lg-Out, and is input to the amplification circuit 550. Here, the amplification control signal Hgd is a signal obtained by level shifting the logical level of the modulation signal Ms, and the amplification control signal Lgd is a signal obtained by inverting the logical level of the modulation signal Ms. Therefore, the amplification control signal Hgd and the amplification control signal Lgd also correspond to the modulation signal generated by the modulation portion 530. Here, the modulation portion 530 is an example of a modulation circuit. In addition, a configuration including the modulation portion 530 and the gate drive portion 540 for level-shifting the modulation signal Ms generated by the modulation portion 530 is also an example of the modulation circuit in a broad sense.

The amplification circuit 550 outputs an amplified modulation signal AMs by operating based on the amplification control signals Hgd and Lgd. In other words, the amplification circuit 550 amplifies the modulation signal Ms and outputs the amplified modulation signal AMs. The amplification circuit 550 includes transistors 551 and 552. Each of the transistors 551 and 552 is, for example, an N-channel field effect transistor (FET).

The voltage signal VHV is supplied to a drain terminal of the transistor 551. The amplification control signal Hgd is supplied to a gate terminal of the transistor 551 through the terminal Hg-Out. A source terminal of the transistor 551 is electrically coupled to a drain terminal of the transistor 552. In addition, the amplification control signal Lgd is supplied to a gate terminal of the transistor 552 through the terminal Lg-Out. A source electrode of the transistor 552 is coupled to the ground. The transistor 551 coupled as described above operates according to the amplification control signal Hgd, and the transistor 552 operates according to the amplification control signal Lgd. That is, the transistors 551 and 552 are exclusively turned on. As a result, the amplified modulation signal AMs obtained by amplifying the modulation signal Ms based on the voltage signal VHV is generated at a coupling point between the source terminal of the transistor 551 and the drain terminal of the transistor 552.

The amplified modulation signal AMs generated by the amplification circuit 550 is input to the demodulation circuit 560. The demodulation circuit 560 includes a coil 561 and a capacitor 562. One end of the coil 561 is commonly coupled to the source terminal of the transistor 551 and the drain terminal of the transistor 552. In addition, the other end of the coil 561 is coupled to one end of the capacitor 562. The other end of the capacitor 562 is coupled to the ground. That is, the coil 561 and the capacitor 562 form a low-pass filter. When the amplified modulation signal AMs is supplied to the low-pass filter, the amplified modulation signal AMs is demodulated, and the drive signal COM is generated. That is, the demodulation circuit 560 demodulates the amplified modulation signal AMs and outputs the drive signal COM. The drive signal COM is output from the drive signal output circuit 51.

In addition, the drive signal COM generated by the demodulation circuit 560 is fed back to the modulation portion 530 through the feedback circuit 570. In other words, the feedback circuit 570 feeds back the drive signal COM to the modulation portion 530. The feedback circuit 570 includes resistors 571 and 572. One end of the resistor 571 is coupled to the other end of the coil 561, and the other end of the resistor 571 is coupled to one end of the resistor 572. The voltage signal VHV2 is supplied to the other end of the resistor 572. The other end of the resistor 571 and one end of the resistor 572 are commonly coupled to a terminal Com-Dis, and coupled to the demodulation circuit 560 through the terminal Com-Dis. That is, the drive signal COM is pulled up by the voltage signal VHV2 through the feedback circuit 570 and is fed back to the modulation portion 530. In other words, the feedback circuit 570 is electrically coupled to the propagation path d through which the voltage signal VHV2 as the voltage signal VHV propagates. Here, the voltage signal VHV2 as the voltage signal VHV output from the power supply voltage control circuit 70 propagates, and the propagation path d that electrically couples the drive signal selection control circuit 200 and the power supply voltage control circuit 70 to each other is an example of a first wiring. Here, the propagation path that is electrically coupled is not limited to a propagation path that directly couples various components electrically, and includes a propagation path coupled through a circuit, an electronic component, a fuse, or the like to such an extent that essential characteristics of a signal propagated through the propagation path are not impaired.

In the following description, a configuration including the amplification control signal generation circuit 502, the amplification circuit 550, the demodulation circuit 560, and the feedback circuit 570 included in the integrated circuit 500 may be referred to as a drive signal generation circuit 501 that generates the drive signal COM based on the drive data signal DATA.

The oscillation circuit 410 generates and outputs a clock signal LCK that defines the operation timing of the integrated circuit 500. The clock signal LCK is input to the clock selection circuit 420 and the abnormality detection circuit 430.

Clock signals MCK and LCK and a clock selection signal CSW are input to the clock selection circuit 420. The clock selection circuit 420 switches whether to output the clock signal MCK to the register control circuit 440 as the clock signal RCK based on the logic level of the clock selection signal CSW, or to output the clock signal LCK to the register control circuit 440 as a clock signal RCK. In the present embodiment, it is described that the clock selection circuit 420 outputs the clock signal MCK to the register control circuit 440 as the clock signal RCK when the clock selection signal CSW is at the H level, and outputs the clock signal LCK to the register control circuit 440 as the clock signal RCK when the clock selection signal CSW is at the L level.

The abnormality detection circuit 430 includes an oscillation abnormality detection portion 431, an operation abnormality detection portion 432, and a power supply voltage abnormality detection portion 433.

The oscillation abnormality detection portion 431 receives the clock signal LCK output from the oscillation circuit 410. The oscillation abnormality detection portion 431 detects whether or not the input clock signal LCK is normal, and outputs a logic level clock selection signal CSW and an error signal NES based on the detection result. For example, the oscillation abnormality detection portion 431 detects at least one of the frequency and voltage level of the clock signal LCK. When at least one of the frequency and voltage level of the clock signal LCK is abnormal, the oscillation abnormality detection portion 431 outputs the clock selection signal CSW at the H level to the clock selection circuit 420 and outputs the error signal NES at the H level to the register control circuit 440. In addition, when both the frequency and the voltage level of the clock signal LCK are normal, the oscillation abnormality detection portion 431 outputs the clock selection signal CSW at the L level to the clock selection circuit 420 and outputs the error signal NES at the L level to the register control circuit 440.

An operation status signal ASS indicating the operation states of various configurations of the drive signal output circuit 51 is input to the operation abnormality detection portion 432. The operation abnormality detection portion 432 detects whether or not the various configurations of the drive signal output circuit 51 are operated normally based on the logic level of the input operation status signal ASS. In the present embodiment, when any of the various configurations of the drive signal output circuit 51 is abnormal, the operation status signal ASS at the H level is input to the operation abnormality detection portion 432. When the operation status signal ASS at the H level is input to the operation abnormality detection portion 432, the operation abnormality detection portion 432 outputs the error signal NES at the H level to the register control circuit 440.

The voltage signal VHV2 that is propagated along the propagation path d and supplied to the print head 21 is input to the power supply voltage abnormality detection portion 433. The power supply voltage abnormality detection portion 433 detects the voltage value of voltage signal VHV2. In other words, the power supply voltage abnormality detection portion 433 detects the voltage value of the propagation path d through which the voltage signal VHV2 as the voltage signal VHV propagates. The power supply voltage abnormality detection portion 433 detects whether or not the voltage level of the voltage signal VHV2 supplied to the print head 21 is normal based on the voltage value of the voltage signal VHV2. In the present embodiment, when the power supply voltage abnormality detection portion 433 determines that the voltage level of the voltage signal VHV2 supplied to the print head 21 is abnormal, the power supply voltage abnormality detection portion 433 outputs the error signal FES at the H level to the register control circuit 440. Here, the power supply voltage abnormality detection portion 433 is an example of a detection circuit.

The register control circuit 440 includes a sequence register 441, a status register 442, and a register control portion 443. The sequence register 441 and the status register 442 hold operation information input as the drive data signal DATA in synchronization with the clock signal MCK. The register control portion 443 generates and outputs control signals CNT1 to CNT6 based on the information held in the sequence register 441 and the status register 442 in synchronization with the clock signal RCK. As a result, the operation of the drive signal output circuit 51 is controlled.

The control signal CNT1 is input to the drive signal discharge circuit 450. The drive signal discharge circuit 450 controls the discharge of the charge based on the drive signal COM output from the demodulation circuit 560 through the feedback circuit 570. That is, the drive signal discharge circuit 450 is electrically coupled, through the feedback circuit 570, to the propagation path e through which the drive signal COM output from the demodulation circuit 560 is propagated.

Figure 14:
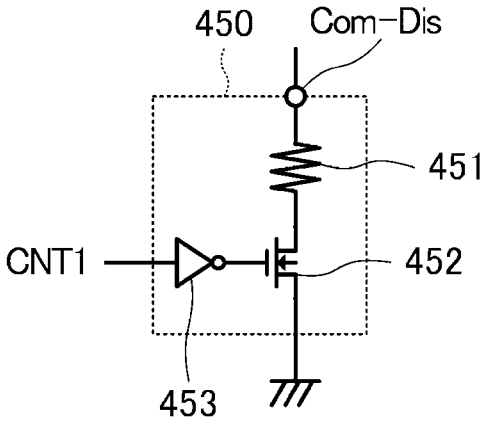
FIG. 14 is a diagram illustrating a configuration of a drive signal discharge circuit.

FIG. 14 is a diagram illustrating a configuration of the drive signal discharge circuit 450. The drive signal discharge circuit 450 includes a resistor 451, a transistor 452, and an inverter 453. In the following description, the transistor 452 is described as an NMOS transistor.

One end of the resistor 451 is coupled to a terminal Com-Dis. The other end of the resistor 451 is coupled to a drain terminal of the transistor 452. A source terminal of the transistor 452 is coupled to the ground. In addition, the control signal CNT1 is input to the gate terminal of the transistor 452 through the inverter 453. When the control signal CNT1 at the H level is input to the drive signal discharge circuit 450 configured as described above, the transistor 452 is controlled to be turned off. Therefore, the drive signal discharge circuit 450 does not discharge the charge stored in the propagation path e. On the other hand, when the control signal CNT1 at the L level is input to the drive signal discharge circuit 450, the transistor 452 is controlled to be turned on. Therefore, the drive signal discharge circuit 450 discharges the charge stored in the propagation path e through the feedback circuit 570. That is, the drive signal discharge circuit 450 discharges the charge stored in the propagation path e where the drive signal COM is supplied to the print head 21 based on the control signal CNT1. Here, the drive signal discharge circuit 450 is an example of a discharge circuit, and the propagation path e is an example of a second wiring.

Figure 15:
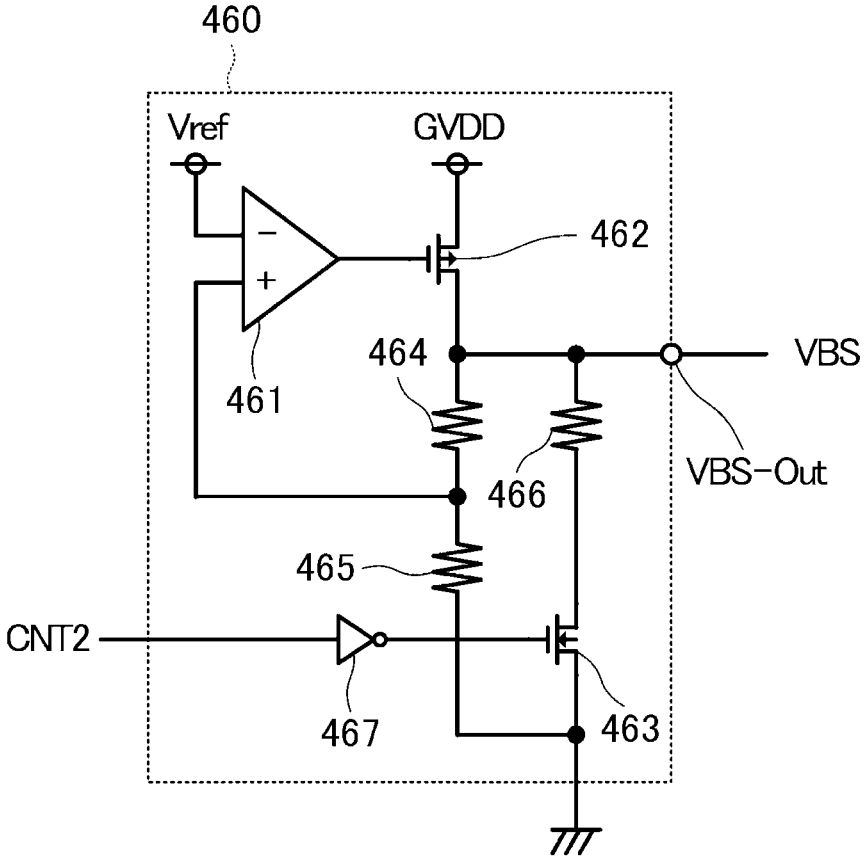
FIG. 15 is a diagram illustrating a configuration of a reference voltage signal output circuit.

The control signal CNT2 is input to the reference voltage signal output circuit 460. The reference voltage signal output circuit 460 generates and outputs a reference voltage signal VBS supplied to the piezoelectric element 60. FIG. 15 is a diagram illustrating a configuration of the reference voltage signal output circuit 460. The reference voltage signal output circuit 460 includes a comparator 461, transistors 462 and 463, resistors 464, 465, and 466, and an inverter 467. In the following description, the transistor 462 is described as a PMOS transistor, and the transistor 463 is described as an NMOS transistor.

A reference voltage Vref is supplied to an input terminal (−) of the comparator 461. In addition, an input terminal (+) of the comparator 461 is coupled commonly to one end of the resistor 464 and one end of the resistor 465. An output terminal of the comparator 461 is coupled to a gate terminal of the transistor 462. A voltage signal GVDD is supplied to a source terminal of the transistor 462. A drain terminal of the transistor 462 is commonly coupled to the other end of the resistor 464, one end of the resistor 466, and a terminal VBS-Out from which the reference voltage signal VBS is output. The other end of the resistor 466 is coupled to a drain terminal of the transistor 463. The control signal CNT2 is input to a gate terminal of the transistor 463 through the inverter 467. A source terminal of the transistor 463 and the other end of the resistor 465 are coupled to the ground.

In the reference voltage signal output circuit 460 configured as described above, when the voltage supplied to the input terminal (+) of the comparator 461 is larger than the reference voltage Vref supplied to the input terminal (−) of the comparator 461, the comparator 461 outputs the signal at the H level. At this time, the transistor 462 is controlled to be off. Therefore, the voltage signal GVDD is not supplied to the terminal VBS-Out. On the other hand, when the voltage supplied to the input terminal (+) of the comparator 461 is smaller than the reference voltage Vref supplied to the input terminal (−) of the comparator 461, the comparator 461 outputs the signal at the L level. At this time, the transistor 462 is controlled to be turned on. Therefore, the voltage signal GVDD is supplied to the terminal VBS-Out. That is, the comparator 461 operates so that the voltage value obtained by dividing the reference voltage signal VBS by the resistors 464 and 465 is equal to the reference voltage Vref. Therefore, the reference voltage signal output circuit 460 generates a reference voltage signal VBS having a constant voltage value based on voltage signal GVDD.

When the control signal CNT2 at the H level is input to the reference voltage signal output circuit 460 configured as described above, the transistor 463 is controlled to be turned off. Therefore, a path that electrically couples the terminal VBS-Out and the ground through the resistor 466 and the transistor 463 is controlled to a high impedance. As a result, a reference voltage signal VBS having a constant voltage value is output from the terminal VBS-Out. On the other hand, when the control signal CNT2 at the L level is input to the reference voltage signal output circuit 460, the transistor 463 is controlled to be turned on. Therefore, the terminal VBS-Out is electrically coupled to the ground through a resistor 576. As a result, the ground potential reference voltage signal VBS is output. In other words, when the control signal CNT2 at the L level is input to the reference voltage signal output circuit 460, the reference voltage signal output circuit 460 stops outputting the reference voltage signal VBS.

Figure 16:
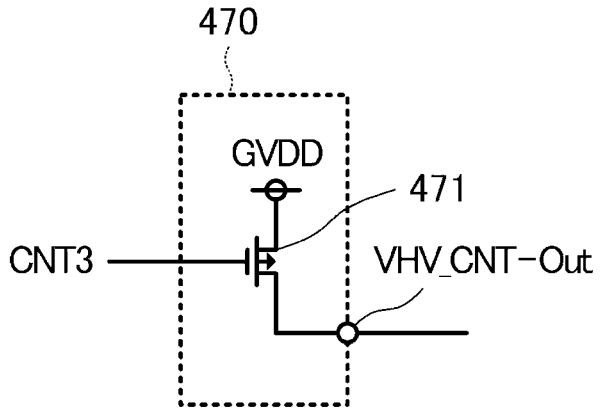
FIG. 16 is a diagram illustrating a configuration of a VHV control signal output circuit.

The control signal CNT3 is input to the VHV control signal output circuit 470. The VHV control signal output circuit 470 outputs a VHV control signal VHV_CNT to be supplied to the power supply voltage control circuit 70. FIG. 16 is a diagram illustrating a configuration of the VHV control signal output circuit 470. The VHV control signal output circuit 470 includes a transistor 471. In the following description, the transistor 471 is described as a PMOS transistor.

The voltage signal GVDD is supplied to a source terminal of the transistor 471. The drain terminal of the transistor 471 is coupled to the terminal VHV_CNT-Out. The control signal CNT3 is input to a gate terminal of the transistor 471. When the control signal CNT3 at the L level is input to the VHV control signal output circuit 470 configured as described above, the voltage signal GVDD is supplied to the terminal VHV_CNT-Out, and when the control signal CNT3 at the H level is input, a signal of the ground potential is supplied to the terminal VHV_CNT-Out. That is, the VHV control signal output circuit 470 inverts the logic level of the control signal CNT3 and outputs a signal amplified by the voltage signal GVDD as the VHV control signal VHV_CNT.

The VHV control signal VHV_CNT output from the VHV control signal output circuit 470 is input to the power supply voltage control circuit 70 as illustrated in FIG. 9. The power supply voltage control circuit 70 controls whether or not to supply the voltage signal VHV2 to the print head 21 based on the input VHV control signal VHV_CNT.

Figure 17:
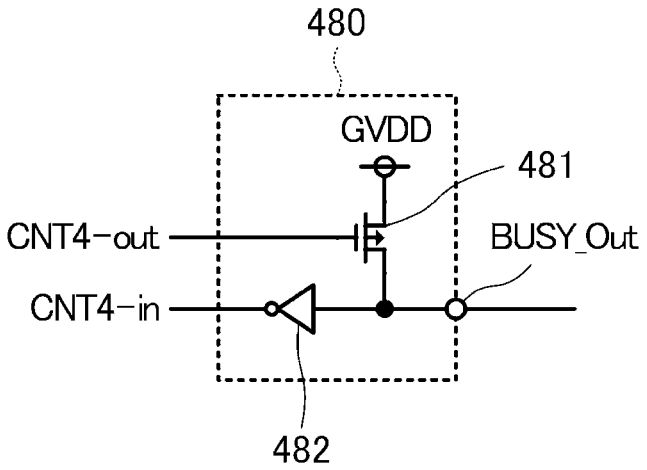
FIG. 17 is a diagram illustrating a configuration of a status signal input and output circuit.

The control signal CNT4 is input to the status signal input and output circuit 480. The status signal input and output circuit 480 outputs a status signal BUSY indicating the operation state of the drive signal output circuit 51, and receives a status signal BUSY output from another configuration. Here, the other configuration may be a different drive signal output circuit 51 when the liquid ejecting apparatus 1 has a plurality of drive signal output circuits 51, for example, and may be the control circuit 100, for example. FIG. 17 is a diagram illustrating a configuration of the status signal input and output circuit 480. The status signal input and output circuit 480 includes a transistor 481 and an inverter 482. In the following description, the transistor 481 is described as a PMOS transistor. In addition, the inverter 482 functions as a COMS input terminal of the integrated circuit 500. That is, the status signal input and output circuit 480 outputs the status signal BUSY from a terminal BUSY-Out based on the control signal CNT4 output from the register control circuit 440, and inputs a signal input to the terminal BUSY-Out to the register control circuit 440. In FIG. 17, the control signal CNT4 output from the register control circuit 440 is illustrated as a control signal CNT4-out, and the control signal CNT4 input to the register control circuit 440 is illustrated as a control signal CNT4-in.

The voltage signal GVDD is supplied to a source terminal of the transistor 481. In addition, a drain terminal of the transistor 481 is coupled to the input terminal of the inverter 482 and the terminal BUSY-Out. In addition, the control signal CNT4-out output from the register control circuit 440 is input to a gate terminal of the transistor 481. In addition, the control signal CNT4-in input to the register control circuit 440 is output from an output terminal of the inverter 482. When the control signal CNT4 at the L level is input to the status signal input and output circuit 480 configured as described above, the voltage signal GVDD is supplied to the terminal BUSY-Out. That is, the status signal BUSY at the H level is output.

Figure 18:
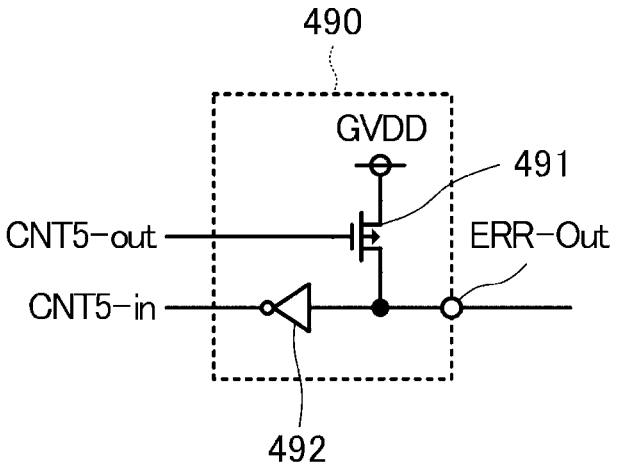
FIG. 18 is a diagram illustrating a configuration of an error signal input and output circuit.

The control signal CNT5 is input to the error signal input and output circuit 490. The error signal input and output circuit 490 outputs an error signal ERR indicating whether or not an abnormality is occurred in the drive signal output circuit 51, and receives an error signal ERR output from another configuration. Here, the other configuration may be a different drive signal output circuit 51 when the liquid ejecting apparatus 1 has a plurality of drive signal output circuits 51, for example, and may be the control circuit 100, for example. FIG. 18 is a diagram illustrating a configuration of the error signal input and output circuit 490. The error signal input and output circuit 490 includes a transistor 491 and an inverter 492. In the following description, the transistor 491 is described as a PMOS transistor. In addition, the inverter 492 functions as a COMS input terminal of the integrated circuit 500. That is, the error signal input and output circuit 490 outputs the error signal ERR from a terminal ERR-Out based on the control signal CNT5 output from the register control circuit 440, and inputs a signal input to the terminal ERR-Out to the register control circuit 440. In FIG. 18, the control signal CNT5 output from the register control circuit 440 is illustrated as a control signal CNT5-out, and the control signal CNT5 input to the register control circuit 440 is illustrated as a control signal CNT5-in.

The voltage signal GVDD is supplied to a source terminal of the transistor 491. In addition, a drain terminal of the transistor 491 is coupled to an input terminal of the inverter 492 and the terminal ERR-Out. In addition, the control signal CNT5-out output from the register control circuit 440 is input to a gate terminal of the transistor 491. In addition, the control signal CNT5-in input to the register control circuit 440 is output from an output terminal of the inverter 492. When the control signal CNT5 at the L level is input to the error signal input and output circuit 490 configured as described above, the voltage signal GVDD is supplied to the terminal ERR-Out. That is, the error signal ERR at the H level is output.

As described above, since the drive signal output circuit 51 includes the status signal input and output circuit 480 and the error signal input and output circuit 490, when the liquid ejecting apparatus 1 includes a plurality of drive signal output circuits 51, the error information and the operation information can be shared between the drive signal output circuits 51. Therefore, when an abnormality occurs in any of the plurality of drive signal output circuits 51, it is possible to control the operation of another drive signal output circuit 51 in which no abnormality is occurred, based on the state information indicating the abnormality.

The control signal CNT6 is input to the amplification control signal generation circuit 502. When the control signal CNT6 is input to the amplification control signal generation circuit 502, the waveform of the drive signal COM generated by the drive signal generation circuit 501 is defined by the control signal CNT6 regardless of the drive data signal DATA. Specifically, the control signal CNT6 may be a signal for causing the drive signal generation circuit 501 to generate a drive signal COM that is constant at a predetermined voltage value, and may be a signal for causing the drive signal generation circuit 501 to generate a drive signal COM that is constant at the ground potential.

In the drive signal output circuit 51 configured as described above, operation information input as the drive data signal DATA in synchronization with the clock signal MCK is held in the sequence register 441. The register control portion 443 performs sequence control of the drive signal output circuit 51 based on the operation information held in the sequence register 441. As the sequence control is executed, information indicating the operation mode is held in the status register 442. The register control circuit 440 controls the output of the control signals CNT1 to CNT6 based on the information indicating the operation mode held in the status register 442. As a result, various signals output from the drive signal output circuit 51 are controlled.

1.5 Sequence Control of Liquid Ejecting Apparatus and Drive Circuit

Figure 19:
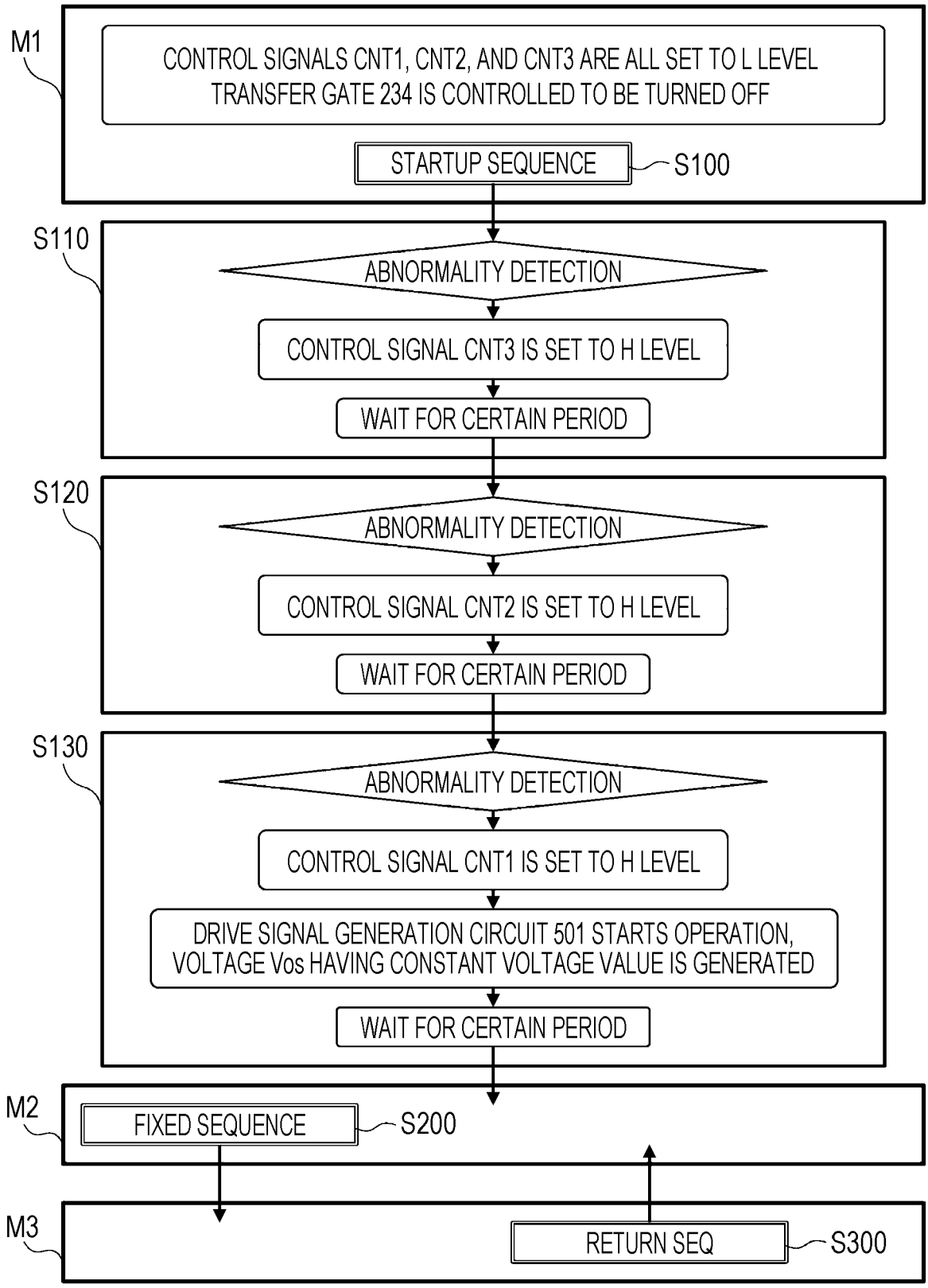
FIG. 19 is a state transition diagram for describing sequence control when the drive signal output circuit is activated.

In the drive signal output circuit 51 configured as described above, a programmable logic controller (PLC) (not illustrated) executes sequence control for controlling the output of the control signals CNT1 to CNT6 based on information held in the sequence register 441 and the status register 442 of the register control circuit 440. Here, the sequence control executed by the drive signal output circuit 51 will be described. FIG. 19 is a state transition diagram for describing the sequence control when the drive signal output circuit 51 is activated.

When the power is supplied to the liquid ejecting apparatus 1, information for transition to a sleep mode M1 is held in the sequence register 441 of the drive signal output circuit 51. The PLC causes the drive signal output circuit 51 to transition to the sleep mode and causes the status register 442 to hold information indicating the sleep mode M1.

The register control circuit 440 sets the control signals CNT1 to CNT3 to the L level, respectively, based on the information held in the status register 442. As a result, the charges stored in both the electrodes 611 and 612 of the piezoelectric element 60 are discharged, and both the electrodes 611 and 612 become the ground potential. In other words, the potentials of the electrode 611 and the electrode 612 are substantially equal to each other. Immediately after the liquid ejecting apparatus 1 is turned on, the information held in the status register 442 may be supplied from the control circuit 100 as the drive data signal DATA, or may be the information held in the register control circuit 440 in advance. Here, the control circuit 100 controls the transfer gate 234 to be turned off in the sleep mode M1.

When the drive data signal DATA for transitioning the state to the drive mode M2 for driving the piezoelectric element 60 is supplied from the control circuit 100, the register control circuit 440 holds information based on the drive data signal DATA in the sequence register 441. The PLC executes a startup sequence S100 based on the information held in the sequence register 441.

By executing the startup sequence S100, the PLC causes the operation state of the drive signal output circuit 51 to transition to the state S110, and causes the status register 442 to hold information indicating the state S110.

In state S110, the register control circuit 440 determines whether or not the operation of each part of the drive signal output circuit 51 and the drive circuit 50 is normal based on the error signals NES and FES input from the abnormality detection circuit 430. Thereafter, the register control circuit 440 sets the control signal CNT3 to the H level based on the information held in the status register 442. As a result, the supply of the voltage signal VHV to the drive signal selection control circuit 200 is started.

After waiting for a certain period in the state S110, the PLC causes the operation state of the drive signal output circuit 51 to transition to the state S120 and causes the status register 442 to hold information indicating the state S120.

In state S120, the register control circuit 440 determines whether or not the operation of each part of the drive signal output circuit 51 and the drive circuit 50 is normal based on the error signals NES and FES input from the abnormality detection circuit 430. Thereafter, the register control circuit 440 sets the control signal CNT2 to the H level based on the information held in the status register 442. As a result, generation of the reference voltage signal VBS is started. At this time, since the transfer gate 234 is controlled to be turned off, the potential of the electrode 611 increases with the supply of the reference voltage signal VBS to the electrode 612 of the piezoelectric element 60. Therefore, the potentials of the electrode 611 and the electrode 612 of the piezoelectric element 60 increase in substantially the same state. The PLC causes the sequence control of the drive circuit 50 to wait for a certain period in the state S120.

After waiting for a certain period in the state S120, the PLC causes the operation state of the drive signal output circuit 51 to transition to the state S130 and causes the status register 442 to hold information indicating the state S120.

In state S130, the register control circuit 440 determines whether or not the operation of each part of the drive signal output circuit 51 and the drive circuit 50 is normal based on the error signals NES and FES input from the abnormality detection circuit 430. Thereafter, the register control circuit 440 sets the control signal CNT1 to the H level based on the information held in the status register 442. The drive signal generation circuit 501 starts the operation. That is, the drive signal generation circuit 501 starts outputting the drive signal COM after the voltage signal VHV is supplied to the transfer gate 234. At this time, the drive signal generation circuit 501 generates a voltage Vos having a constant voltage value as the drive signal COM based on the control signal CNT6. Here, the voltage value of voltage Vos is set to be the same as the set voltage value of reference voltage signal VBS. In other words, in state S130, the voltage value of drive signal COM is controlled so as to approach the voltage value of reference voltage signal VBS. The PLC waits for a certain period in sequence control of the drive signal output circuit 51 in the state S130.

After waiting for a certain period in the state S130, the PLC causes the operation state of the drive signal output circuit 51 to transition to the drive mode M2 and causes the status register 442 to hold information indicating the drive mode M2. After transitioning to the drive mode M2, the control circuit 100 controls the transfer gate 234 to turn on. At this time, the terminal TG-In of the transfer gate 234 is supplied with the voltage Vos having a constant voltage value equivalent to the potential of the reference voltage signal VBS as the drive signal COM, and the terminal TG-Out of the transfer gate 234 is supplied with a voltage equivalent to the potential of the reference voltage signal VBS. Therefore, even immediately after the transfer gate 234 is controlled to be turned on, the possibility that a reverse polarity electric field is generated between the electrode 611 and the electrode 612 of the piezoelectric element 60 is reduced. The drive signal generation circuit 501 controls the voltage value of the drive signal COM to the voltage Vc based on the drive data signal DATA input from the control circuit 100. Thereafter, the control circuit 100 controls the transfer gate 234 to be turned off.

In addition, in a standby state where the piezoelectric element 60 is not driven, and when no image data is supplied from the host computer, the drive signal output circuit 51 has a fixed output mode M3 that can transition to the drive mode M2 in a shorter time than the sleep mode M1. When the drive data signal DATA for transitioning the state to the fixed output mode M3 is supplied from the control circuit 100 in the drive mode M2, the register control circuit 440 holds information based on the drive data signal DATA in the sequence register 441. The PLC executes a fixed sequence S200. As a result, the drive signal output circuit 51 transitions to the fixed output mode M3. In the fixed output mode M3, the drive signal generation circuit 501 stops the operation, and a signal of a constant voltage generated by a voltage generation circuit (not illustrated) is output from the drive signal output circuit 51. As a result, it is possible to achieve both a reduction in power consumption caused by the operation of the drive signal generation circuit 501 and a transition to the drive mode M2 in a short time.

In addition, in the fixed output mode M3, when the drive data signal DATA for transitioning the state to the drive mode M2 is supplied from the control circuit 100, the register control circuit 440 holds information based on the drive data signal DATA in the sequence register 441. The PLC executes a return sequence S300. As a result, the drive signal generation circuit 501 starts the operation, and the operation state of the drive signal output circuit 51 transitions to the drive mode M2.

Figure 20:
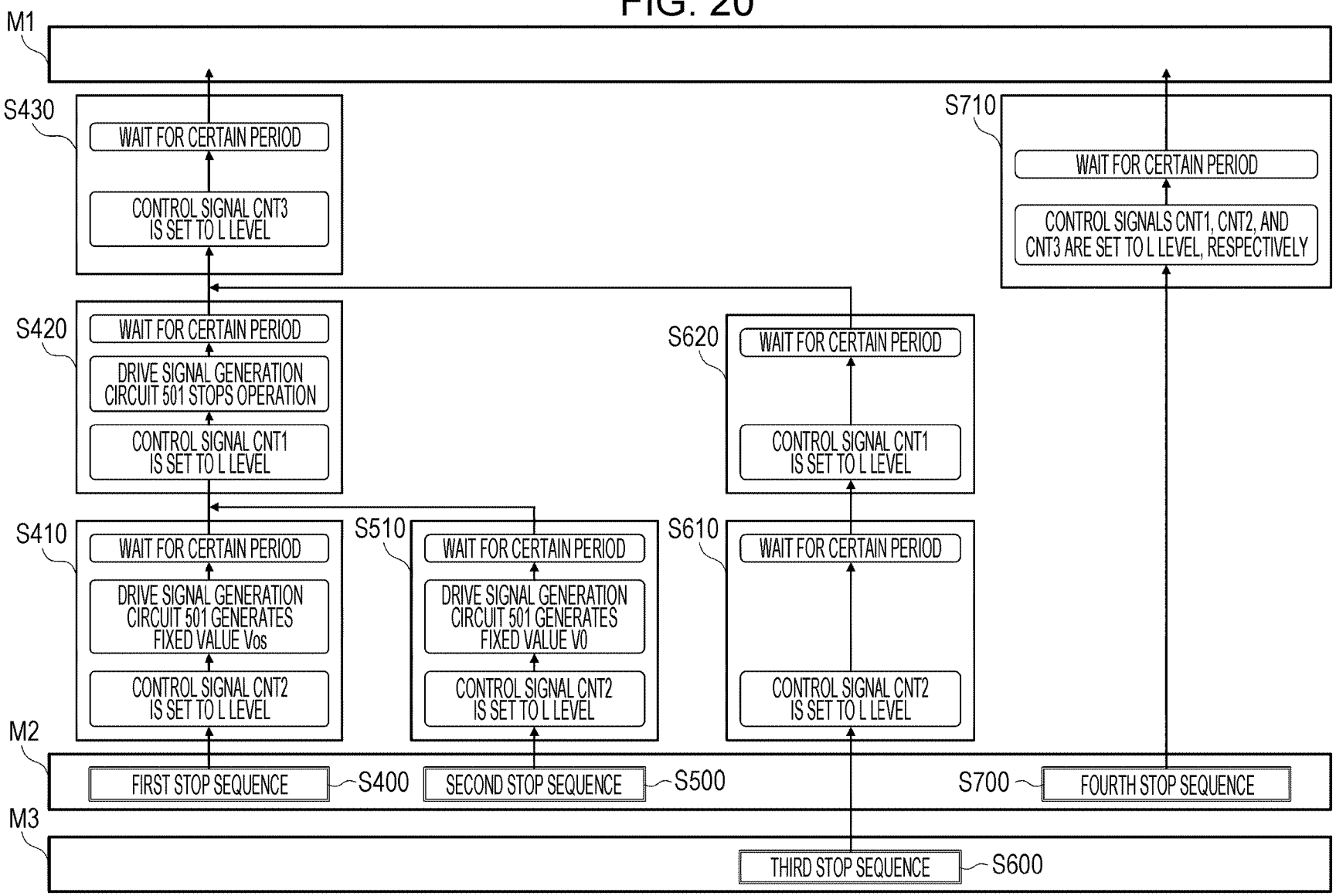
FIG. 20 is a state transition diagram for describing sequence control when an operation of the drive signal output circuit is stopped.

Next, sequence control when the operation of the drive signal output circuit 51 is stopped will be described. FIG. 20 is a state transition diagram for describing the sequence control when the operation of the drive signal output circuit 51 is stopped. As illustrated in FIG. 20, the drive signal output circuit 51 includes a first stop sequence S400, a second stop sequence S500, a third stop sequence S600, and a fourth stop sequence S700 as sequence control when the operation is stopped.

The first stop sequence S400 is sequence control for transitioning the operation state of the drive signal output circuit 51 from the drive mode M2 to the sleep mode M1 in a state where the drive circuit 50 normally operates. Specifically, in the drive mode M2, when the drive data signal DATA for transitioning the state to the sleep mode M1 is supplied from the control circuit 100, the register control circuit 440 holds information based on the drive data signal DATA in the sequence register 441. The PLC executes the first stop sequence S400 based on the information held in the sequence register 441.

When the first stop sequence S400 is executed, the PLC causes the operation state of the drive signal output circuit 51 to transition to a state S410, and causes the status register 442 to hold information indicating the state S410.

In state S410, the register control circuit 440 sets the control signal CNT2 to the L level based on the information held in the status register 442. As a result, the supply of the reference voltage signal VBS to the piezoelectric element 60 is stopped, and the electrode 612 is coupled to the ground potential. Therefore, the charge stored in the electrode 612 of the piezoelectric element 60 is discharged. In addition, in the state S410, the drive signal generation circuit 501 generates the voltage Vos as the drive signal COM based on the control signal CNT6. Thereafter, the PLC causes the operation state of the drive signal output circuit 51 to wait for a certain period in the state S410.

After waiting for a certain period in the state S410, the PLC causes the operation state of the drive signal output circuit 51 to transition to the state S420, and causes the status register 442 to hold information indicating the state S420.

In state S420, the register control circuit 440 sets the control signal CNT1 to the L level based on the information held in the status register 442. As a result, the charge stored in the propagation path e is discharged based on the drive signal COM. In addition, in the state S410, the drive signal generation circuit 501 stops the operation. The PLC causes the operation state of the drive signal output circuit 51 to wait for a certain period in the state S420. As a result, the electrodes 611 and 612 of the piezoelectric element 60 both have the ground potential. Therefore, the possibility that a reverse polarity electric field is applied to the piezoelectric element 60 and the possibility that unintended displacement occurs in the piezoelectric element 60 are reduced.

After waiting for a certain period in the state S420, the PLC causes the operation state of the drive signal output circuit 51 to transition to the state S430 and causes the status register 442 to hold information indicating the state S430.

In state S430, the register control circuit 440 sets the control signal CNT3 to the L level based on the information held in the status register 442. The PLC waits the operation state of the drive signal output circuit 51 for a certain period in the state S430.

After waiting for a certain period in the state S430, the PLC causes the operation state of the drive signal output circuit 51 to transition to the sleep mode M1, and causes the status register 442 to hold information indicating the sleep mode M1. After transitioning to the sleep mode M1, the control circuit 100 controls the transfer gate 234 to be turned off. As a result, in the sleep mode M1, both the electrode 611 and the electrode 612 of the piezoelectric element 60 are held in a state where the ground potential is supplied. Therefore, in the sleep mode M1, it is possible to reduce a possibility that an unintended displacement occurs in the piezoelectric element 60 due to an unintended voltage being applied to the electrodes 611 and 612 of the piezoelectric element 60.

In the abnormality detection circuit 430, when it is detected that a minor operation abnormality is occurred in the drive signal output circuit 51 or the drive circuit 50, the second stop sequence S500 is sequence control for causing the operation state of the drive signal output circuit 51 to transition to the sleep mode M1 from the drive mode M2. Specifically, in the drive mode M2, when the drive data signal DATA for transitioning the state to the sleep mode M1 is supplied from the control circuit 100 due to a minor operation abnormality occurring in the drive signal output circuit 51 or the drive circuit 50, the register control circuit 440 holds information based on the drive data signal DATA in the sequence register 441. The PLC executes the second stop sequence S500 based on the information held in the sequence register 441. At this time, the register control circuit 440 outputs the control signals CNT4 and CNT5 at the L level. As a result, the control circuit 100 is notified that an abnormality is occurred in the drive signal output circuit 51 or the drive circuit 50.

When the second stop sequence S500 is executed, the PLC causes the operation state of the drive signal output circuit 51 to transition to a state S510 and causes the status register 442 to hold information indicating the state S510.

In state S510, the register control circuit 440 sets the control signal CNT2 to the L level based on the information held in the status register 442. As a result, the supply of the reference voltage signal VBS to the piezoelectric element 60 is stopped, and the electrode 612 is coupled to the ground potential. Therefore, the charge stored in the electrode 612 of the piezoelectric element 60 is discharged. In addition, in the state S510, the drive signal generation circuit 501 generates the ground potential voltage VO as the drive signal COM based on the control signal CNT6. Thereafter, the PLC causes the operation state of the drive signal output circuit 51 to wait for a certain period in a state S510.

After waiting for a certain period in the state S510, the PLC causes the operation state of the drive signal output circuit 51 to transition to the state S420 and causes the status register 442 to hold information indicating the state S420. Thereafter, the operation state of the drive signal output circuit 51 transitions between the state S420, the state S430, and the sleep mode M1, similar to the first stop sequence. The second stop sequence S500 described above is executed when a minor operation abnormality occurs in the drive signal output circuit 51. By setting the drive signal COM generated by the drive signal generation circuit 501 in the state S510 to the ground potential voltage VO, the effect of the operation abnormality can be reduced.

The third stop sequence S600 is a sequence control for transitioning the operation state of the drive signal output circuit 51 from the fixed output mode M3 to the sleep mode M1. Specifically, in the fixed output mode M3, when the drive data signal DATA for transitioning the state to the sleep mode M1 is supplied from the control circuit 100, the register control circuit 440 holds information based on the drive data signal DATA in the sequence register 441. The PLC executes the third stop sequence S600 based on the information held in the sequence register 441.

When the third stop sequence S600 is executed, the PLC causes the operation state of the drive signal output circuit 51 to transition to the state S510 and causes the status register 442 to hold information indicating a state S610.

In state S610, the register control circuit 440 sets the control signal CNT2 to the L level based on the information held in the status register 442. As a result, the supply of the reference voltage signal VBS to the piezoelectric element 60 is stopped, and the electrode 612 is coupled to the ground potential. The PLC causes the operation state of the drive signal output circuit 51 to wait for a certain period in the state S610. After waiting for a certain period in the state S610, the PLC causes the operation state of the drive signal output circuit 51 to transition to the state S620 and causes the status register 442 to hold information indicating the state S620. In state S620, the register control circuit 440 sets the control signal CNT1 to the L level based on the information held in the status register 442. The PLC causes the operation state of the drive signal output circuit 51 to wait for a certain period in the state S620.

After waiting for a certain period in the state S620, the PLC causes the operation state of the drive signal output circuit 51 to transition to the state S430, and causes the status register 442 to hold information indicating the state S430. Thereafter, the operation state of the drive signal output circuit 51 transitions between the state S430 and the sleep mode M1, similar to the first stop sequence. As described above, since the drive signal generation circuit 501 stops the operation in the fixed output mode M3, the third stop sequence S600 differs from the first stop sequence S400 and the second stop sequence S500 in that the third stop sequence S600 does not include a treatment for stopping the operation of the drive signal generation circuit 501 and the like.

In the abnormality detection circuit 430, when it is detected that a non-minor abnormality such as a voltage drop due to blowing of a fuse or abnormal information held in various registers including the sequence register 441 or the status register 442 is occurred in the drive signal output circuit 51 or the drive circuit 50, the fourth stop sequence S700 is a sequence control for transitioning the operation state of the drive signal output circuit 51 to the sleep mode M1. Specifically, in the drive mode M2, when the register control circuit 440 determines that the non-minor abnormality is occurred based on the error signals NES and FES input from the abnormality detection circuit 430, the PLC executes the fourth stop sequence S700. At this time, the register control circuit 440 outputs the control signals CNT4 and CNT5 at the L level. As a result, the control circuit 100 is notified that an abnormality is occurred in the drive signal output circuit 51 or the drive circuit 50.

Here, as for the detection of the blown fuse, the register control circuit 440 determines that at least one of the fuses 80 and 81 is blown by detecting a decrease in the voltage value of the voltage signal VHV by the power supply voltage abnormality detection portion 433. When it is determined that at least one of the fuses 80 and 81 is blown, the register control circuit 440 outputs the control signal CNT1 at the L level to the drive signal discharge circuit 450. As a result, the drive signal discharge circuit 450 discharges the charge stored in the propagation path e, and the supply of the drive signal COM to the print head 21 stops. In other words, when the power supply voltage abnormality detection portion 433 detects a decrease in the voltage value of the voltage signal VHV, the drive signal discharge circuit 450 discharges the charge in the propagation path e.

When the fourth stop sequence S700 is executed, the PLC causes the operation state of the drive signal output circuit 51 to transition to the state S710 and causes the status register 442 to hold a data signal indicating the state S710.

In state S710, the register control circuit 440 sets the control signals CNT1, CNT2, and CNT3 to all L levels based on the information held in the status register 442. As a result, the charge in the path through which the drive signal COM, the reference voltage signal VBS, and the voltage signal VHV output from the drive signal output circuit 51 propagate is discharged, and the supply of the drive signal COM, the reference voltage signal VBS, and the voltage signal VHV to the print head 21 stops. After causing the operation state of the drive signal output circuit 51 to wait for a certain period in the state S710, and the PLC causes the operation state to transition to the sleep mode M1.

As described above, in the abnormality detection circuit 430, when it is detected that a non-minor abnormality such as a voltage drop due to blowing of a fuse or abnormal information held in various registers including the sequence register 441 or the status register 442 is occurred in the drive signal output circuit 51, the supply of the drive signal COM, the reference voltage signal VBS, and the voltage signal VHV to the print head 21 is stopped. Therefore, it is possible to reduce the possibility that the abnormality affects other components of the liquid ejecting apparatus 1.

1.6 Effects

As described above, in the drive circuit 50 and the liquid ejecting apparatus 1 according to the present embodiment, the feedback circuit 570 is electrically coupled to the propagation path d in which the voltage signal VHV propagates as the voltage signal VHV2, and the propagation path d electrically couples the drive signal selection control circuit 200 and the power supply voltage control circuit 70 to each other. That is, when the power supply voltage control circuit 70 is cut off the voltage signal VHV1, the voltage signal VHV2 is not supplied to the propagation path d. Therefore, the voltage signal VHV2 is not supplied to the drive signal selection control circuit 200. As a result, the possibility that a leak current is generated in the drive signal selection control circuit 200 is reduced, and the possibility that unintended charges are accumulated in the piezoelectric element 60 is reduced. Therefore, the possibility that unintended displacement occurs in the piezoelectric element 60 is reduced.

Furthermore, in the drive circuit 50 and the liquid ejecting apparatus 1 according to the present embodiment, the drive signal discharge circuit 450 is electrically coupled to the propagation path e through which the drive signal COM output from the demodulation circuit 560 propagates through the feedback circuit 570. In addition, the feedback circuit 570 is electrically coupled to the propagation path d. Therefore, when the power supply voltage control circuit 70 cuts off the voltage signal VHV1, the voltage signal VHV2 is not supplied to the propagation path e through the feedback circuit 570. Therefore, by discharging the charge stored in the propagation path e through the drive signal discharge circuit 450, the possibility that a leak current is generated in the selection circuit 230 is reduced. As a result, the possibility that unintended charges are accumulated in the piezoelectric element 60 through the selection circuit 230 is also reduced. Therefore, the possibility that unintended displacement occurs in the piezoelectric element 60 is further reduced.

2. Second Embodiment

The liquid ejecting apparatus 1 and the drive circuit 50 of the second embodiment differs from the first embodiment in a coupling relationship between the power supply voltage control circuit 70 and the fuses 80 and 81, and the power supply voltage control circuit 70 does not include the rush current reduction circuit 73, in the power supply voltage supply control circuit 52 provided in the drive circuit 50. In describing the liquid ejecting apparatus 1 and the drive circuit 50 of the second embodiment, the same components as those of the liquid ejecting apparatus 1 and the drive circuit 50 of the first embodiment are denoted by the same reference numerals, and the description thereof will be simplified or omitted.

Figure 21:
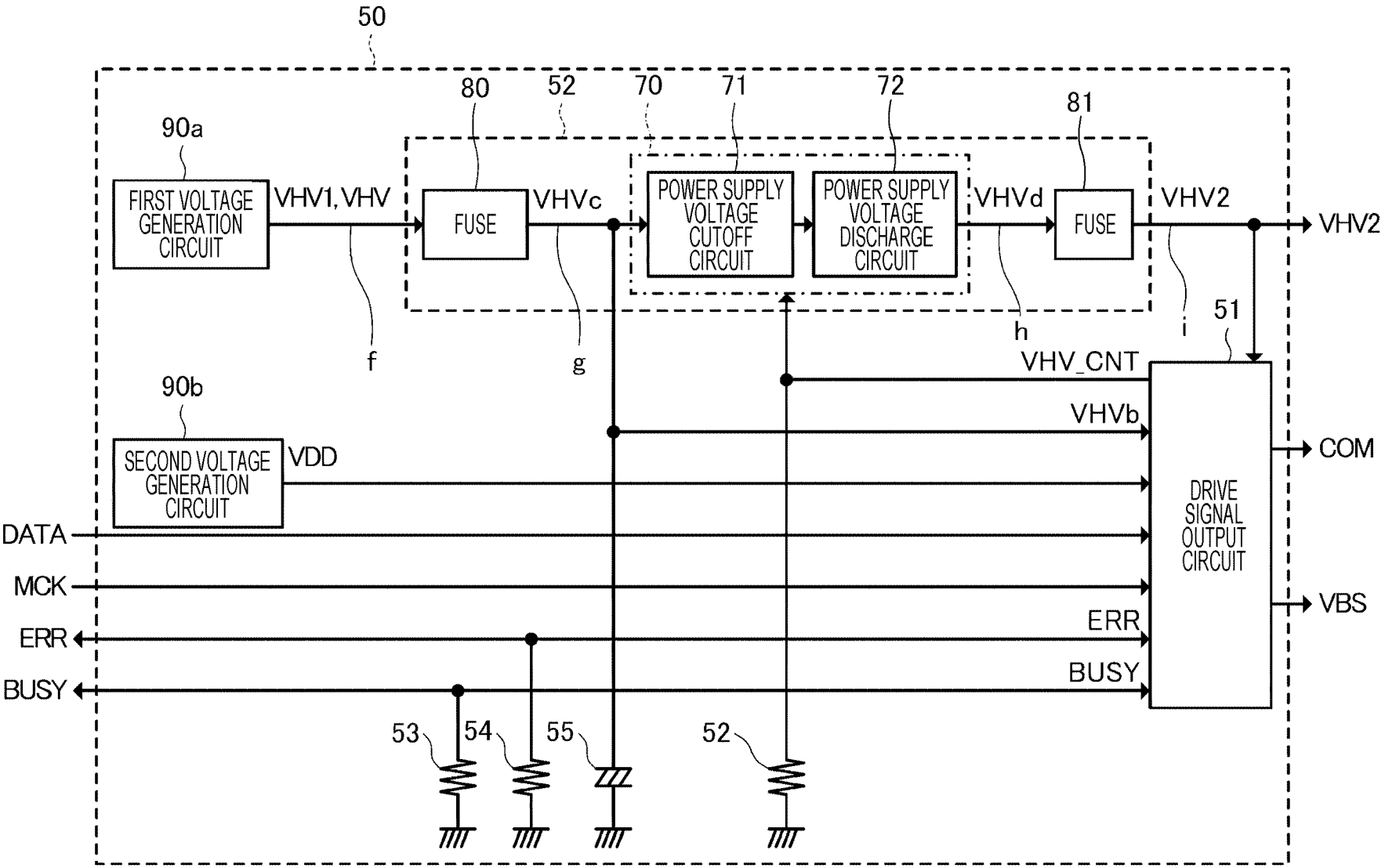
FIG. 21 is a block diagram illustrating a configuration of a drive circuit according to a second embodiment.

FIG. 21 is a block diagram illustrating a configuration of the drive circuit 50 according to the second embodiment. As illustrated in FIG. 21, the drive circuit 50 is provided with the power supply voltage supply control circuit 52, the drive signal output circuit 51, the first voltage generation circuit 90*a*, and the second voltage generation circuit 90*b*, similar to the first embodiment.

The voltage signal VHV1 output from the first voltage generation circuit 90*a* propagates along a propagation path f and is input to the power supply voltage supply control circuit 52.

The power supply voltage supply control circuit 52 includes the power supply voltage control circuit 70 and the fuses 80 and 81. The voltage signal VHV1 input to the power supply voltage supply control circuit 52 propagates along the propagation path f and is input to the fuse 80 of the power supply voltage supply control circuit 52. The fuse 80 outputs the input voltage signal VHV1 as a voltage signal VHVc. The voltage signal VHVc propagates along a propagation path g and is input to power supply voltage control circuit 70. The power supply voltage control circuit 70 controls whether or not to output the input voltage signal VHVc as a voltage signal VHVd. The voltage signal VHVd output from the power supply voltage control circuit 70 propagates along a propagation path h and is input to the fuse 81. The fuse 81 outputs the input voltage signal VHVd as a voltage signal VHV2. The voltage signal VHV2 propagates along a propagation path i and is output from the drive circuit 50. The voltage signal VHV2 output from the drive circuit 50 is input to the drive signal selection control circuit 200 included in the print head 21, similar to the first embodiment. That is, the power supply voltage control circuit 70 is electrically coupled to the drive signal selection control circuit 200 and controls the supply of the voltage signal VHV to the drive signal selection control circuit 200. The propagation paths f, g, h, and i may be, for example, a wiring pattern of a circuit substrate on which the drive circuit 50 is mounted, may be a wiring pattern inside an integrated circuit, or may be a wiring pattern provided inside the integrated circuit.

In addition, the voltage signal VHVc is branched on the propagation path g. One of the branched voltage signals VHVc is input to the power supply voltage control circuit 70, and the other of the branched voltage signals VHVc is input to the drive signal output circuit 51. The voltage signal VHVc input to the drive signal output circuit 51 is input to the amplification circuit 550 included in the drive signal generation circuit 501 as the voltage signal VHVb in the configuration of the drive signal output circuit 51 illustrated in FIG. 13. That is, the propagation path g, which is a wiring electrically coupling the first voltage generation circuit 90*a* and the power supply voltage control circuit 70 to each other, and the amplification circuit 550 are electrically coupled to each other. Similarly, the voltage signal VHV2 is branched on the propagation path i. One of the branched voltage signals VHV2 is input to the print head 21, and the other of the branched voltage signals VHV2 is input to the drive signal output circuit 51. That is, the voltage signal VHV2 obtained by passing the voltage signal VHVc input to the power supply voltage control circuit 70 and the voltage signal VHVd output from the power supply voltage control circuit 70 through the fuse 81 is input to the drive signal output circuit 51.

Here, as illustrated in FIG. 21, the capacitor 55 for reducing voltage fluctuation is coupled to the propagation path g through which the voltage signal VHVc is supplied to the drive signal output circuit 51. As described above, the voltage signal VHVc is input to the amplification circuit 550 included in the drive signal output circuit 51. The amplification circuit 550 operates based on the amplification control signals Hgd and Lgd, and generates an amplified modulation signal MSa by amplifying the modulation signal Ms to a voltage value based on the voltage signal VHVc. The demodulation circuit 560 generates a drive signal COM by demodulating the amplified modulation signal MSa. Therefore, when the voltage value of the voltage signal VHVc fluctuates, a waveform of the drive signal COM is distorted, and the ejection accuracy of the ink is deteriorated. That is, the capacitor 55 reduces the fluctuation of the voltage value of the voltage signal VHVc input to the drive signal output circuit 51, and thus the possibility that the ejection accuracy of the ink ejected from the liquid ejecting apparatus 1 is deteriorated can be reduced.

A capacitor having a large capacitance value may be used as the capacitor 55 for reducing such fluctuations in the voltage value. In the drive circuit 50 according to the second embodiment, the voltage signal VHVc input to the power supply voltage control circuit 70 is input to the amplification circuit 550 of the drive signal output circuit 51. Therefore, the voltage signal VHVc as the voltage signal VHV is supplied to the capacitor 55 regardless of the logic level of the VHV control signal VHV_CNT input to the power supply voltage control circuit 70. In other words, a sufficient charge is stored in the capacitor 55 regardless of the logic level of the VHV control signal VHV_CNT input to the power supply voltage control circuit 70. Therefore, the logic level of the VHV control signal VHV_CNT input to the power supply voltage control circuit 70 changes from L level to H level, and even when the power supply voltage control circuit 70 starts outputting the voltage signal VHVd, the possibility that a large rush current occurs in the path through which the voltage signal VHVd propagates is reduced. Therefore, in the drive circuit 50 according to the second embodiment, the power supply voltage control circuit 70 does not need to include the rush current reduction circuit 73.

As described above, in the liquid ejecting apparatus 1 according to the second embodiment, the same functions and effects as those of the first embodiment can be obtained in the power supply voltage supply control circuit 52 provided in the drive circuit 50, and even when the power supply voltage control circuit 70 do not include the rush current reduction circuit 73, in the liquid ejecting apparatus 1 and the drive circuit 50 according to the second embodiment. Therefore, the sizes of the liquid ejecting apparatus 1 and the drive circuit 50 can be reduced.

Hereinbefore, although embodiment and the modification are described, this disclosure is not limited to these embodiments, and it is possible to implement in various aspects without departing from the gist. For example, the above-described embodiment can be appropriately combined.

The present disclosure includes configurations that are substantially the same as the configurations described in the embodiment (for example, configurations that have the same functions, methods, and results, or configurations that have the same objects and effects). In addition, the present disclosure includes a configuration in which a non-essential part of the configuration described in the embodiment is replaced. In addition, the present disclosure includes a configuration that exhibits the same operational effects as the configuration described in the embodiment or a configuration that can achieve the same object. In addition, the present disclosure includes a configuration in which a known technique is added to the configuration described in the embodiment.

What is claimed is:

1. A drive circuit that drives a piezoelectric device including a piezoelectric element to which a drive signal is supplied, and a drive signal selection control circuit which controls supply of the drive signal to the piezoelectric element, the drive circuit comprising:

a drive signal output circuit that outputs the drive signal;

a power supply voltage signal output circuit that outputs a power supply voltage signal;

a power supply voltage control circuit that controls supply of the power supply voltage signal to the drive signal selection control circuit; and a detection circuit that detects a voltage value of the first wiring through which the power supply voltage signal propagates, wherein the drive signal output circuit includes a modulation circuit that modulates an original drive signal and outputs a modulation signal, an amplification circuit that amplifies the modulation signal and outputs an amplified modulation signal, a demodulation circuit that demodulates the amplified modulation signal and outputs the drive signal, a feedback circuit that feeds back the drive signal to the modulation circuit, and a discharge circuit electrically coupled to the feedback circuit, the feedback circuit is electrically coupled to a first wiring through which the power supply voltage signal propagates, the first wiring electrically couples the drive signal selection control circuit and the power supply voltage control circuit to each other, the discharge circuit is electrically coupled to a second wiring through which the drive signal output from the demodulation circuit propagates, through the feedback circuit, and the discharge circuit discharged a charge of the second wiring when the detection circuit detects a decrease in the voltage value.

2. The drive circuit according to claim 1, wherein a wiring that electrically couples the power supply voltage signal output circuit and the power supply voltage control circuit to each other, and the amplification circuit are electrically coupled to each other.

3. A liquid ejecting apparatus comprising:

the drive circuit according to claim 1; and a print head that includes the piezoelectric device.

* * * * *